US008291647B2

(12) United States Patent
Esposito

(10) Patent No.: US 8,291,647 B2
(45) Date of Patent: Oct. 23, 2012

(54) SELF-CONTAINED STRUCTURE CONFIGURABLE AS A SHIPPING CONTAINER AND AS A DWELLING

(76) Inventor: Joseph Esposito, Huntington Bay, NY (US)

( * ) Notice: Subject to any disclaimer, the term of this patent is extended or adjusted under 35 U.S.C. 154(b) by 5 days.

(21) Appl. No.: 12/878,646

(22) Filed: Sep. 9, 2010

(65) Prior Publication Data

US 2011/0041415 A1 Feb. 24, 2011

Related U.S. Application Data

(63) Continuation of application No. 12/074,584, filed on Mar. 5, 2008.

(60) Provisional application No. 61/241,178, filed on Sep. 10, 2009.

(51) Int. Cl.

| | |
|---|---|
| ***E04B 1/346*** | (2006.01) |
| ***E04B 7/16*** | (2006.01) |
| ***E04B 1/34*** | (2006.01) |
| ***E04D 13/00*** | (2006.01) |
| ***E04H 1/00*** | (2006.01) |

(52) U.S. Cl. ..... 52/66; 52/11; 52/69; 52/79.5

(58) Field of Classification Search ..... 52/79.1, 52/79.5, 11, 64, 65, 66, 69, 71

See application file for complete search history.

(56) References Cited

U.S. PATENT DOCUMENTS

| | | | | |
|---|---|---|---|---|
| 2,944,852 | A | 7/1960 | Snyder | |
| 3,490,807 | A | 1/1970 | Sare | |
| 3,658,375 | A | 4/1972 | Bowen | |
| 3,744,841 | A | 7/1973 | Schmidt | |
| 3,768,855 | A | 10/1973 | Laue | |
| 3,778,528 | A | 12/1973 | Heifetz et al. | |
| 3,809,426 | A | 5/1974 | Ratcliff | |
| 3,824,749 | A * | 7/1974 | Scherf | 52/11 |
| 3,941,414 | A | 3/1976 | Platt | |
| 4,075,814 | A | 2/1978 | Theurer et al. | |
| 4,165,117 | A | 8/1979 | Kaiser | |

(Continued)

FOREIGN PATENT DOCUMENTS

AU 2006906800 * 12/2006

(Continued)

*Primary Examiner* — Joshua J Michener
*Assistant Examiner* — Andrew Triggs
(74) *Attorney, Agent, or Firm* — Dilworth & Barrese, LLP.

(57) ABSTRACT

A self-contained structure configurable as a shipping container and as a dwelling is provided. The self-contained structure configurable as a shipping container and as a dwelling includes a lower section including a platform and a floor, said lower section forming a first portion of a foundation of said dwelling; an upper section including a ceiling and connected to the lower section to define a cavity, said upper section forming a first portion of a roof of said dwelling; a plurality of wall components attached to said lower section and said upper section within said cavity to form subcavities within said cavity; a plurality of panels attachable to said lower section and said upper section to enclose said cavity when the structure is configured as the shipping container and attachable to said upper section to form a second portion of said roof of said dwelling extending from said first portion of said roof to define an approximate area of said dwelling when the structure is configured as the dwelling; and a plurality of extension walls storable within said subcavities when the structure is configured as the shipping container and configurable to enclose said approximate area of said dwelling when the structure is configured as the dwelling.

18 Claims, 14 Drawing Sheets

U.S. PATENT DOCUMENTS

| | | | | |
|---|---|---|---|---|
| 4,201,413 | A | 5/1980 | Rowe | |
| 4,221,441 | A | 9/1980 | Bain | |
| 4,501,098 | A | 2/1985 | Gregory | |
| 4,513,545 | A | 4/1985 | Hopkins, Jr. | |
| 4,534,141 | A * | 8/1985 | Fagnoni | 52/68 |
| 4,539,780 | A | 9/1985 | Rice | |
| 4,955,166 | A | 9/1990 | Qualline et al. | |
| 5,028,088 | A | 7/1991 | Del Monico et al. | |
| 5,076,310 | A | 12/1991 | Barenburg | |
| 5,080,426 | A | 1/1992 | Johnson | |
| 5,127,201 | A | 7/1992 | Skvaril | |
| 5,135,278 | A | 8/1992 | Kauffman et al. | |
| 5,315,794 | A | 5/1994 | Pearson | |
| 5,447,000 | A | 9/1995 | Larsen | |
| 5,491,934 | A | 2/1996 | Bigelow et al. | |
| 5,596,844 | A * | 1/1997 | Kalinowski | 52/79.5 |
| 5,606,835 | A * | 3/1997 | Champagne | 52/545 |
| 5,652,976 | A | 8/1997 | Hopper | |
| 5,724,773 | A | 3/1998 | Hall | |
| 5,730,179 | A | 3/1998 | Taylor | |
| 5,761,854 | A | 6/1998 | Johnson et al. | |
| 5,794,396 | A * | 8/1998 | Gibbs | 52/518 |
| 5,950,373 | A | 9/1999 | von Hoff et al. | |
| 5,950,374 | A | 9/1999 | Gromat | |
| 5,961,176 | A | 10/1999 | Tilly | |
| 5,966,956 | A | 10/1999 | Morris et al. | |
| 5,971,471 | A | 10/1999 | Gardner | |
| 5,979,972 | A | 11/1999 | Gehman | |
| 6,017,080 | A | 1/2000 | Gill | |
| 6,067,771 | A | 5/2000 | Blankenship | |
| 6,080,927 | A * | 6/2000 | Johnson | 136/248 |
| 6,149,225 | A | 11/2000 | Kellner | |
| 6,170,502 | B1 | 1/2001 | Pullen | |
| 6,260,312 | B1 | 7/2001 | Spene et al. | |
| 6,263,637 | B1 | 7/2001 | Spene et al. | |
| 6,266,863 | B1 | 7/2001 | Spene et al. | |
| 6,279,767 | B1 | 8/2001 | Yoon | |
| 6,325,447 | B1 | 12/2001 | Kuo | |
| 6,434,896 | B1 | 8/2002 | Mitchell | |
| 6,527,336 | B2 | 3/2003 | Hernandez et al. | |
| 6,817,642 | B1 | 11/2004 | Warning | |
| 6,826,879 | B1 | 12/2004 | Allen et al. | |
| 6,889,395 | B1 * | 5/2005 | Hodges | 4/665 |
| 6,983,567 | B2 | 1/2006 | Ciotti | |
| 7,090,286 | B1 | 8/2006 | Foreth et al. | |
| 7,117,645 | B2 | 10/2006 | Bzorgi | |
| 7,246,844 | B2 | 7/2007 | Guidry | |
| 7,325,364 | B2 | 2/2008 | Leininger et al. | |
| 7,334,697 | B2 | 2/2008 | Myers et al. | |
| 7,390,052 | B2 | 6/2008 | Bertoch et al. | |
| 7,418,802 | B2 | 9/2008 | Sarine et al. | |
| 7,603,823 | B2 | 10/2009 | Cann | |
| 7,827,738 | B2 | 11/2010 | Abrams et al. | |
| 2002/0116878 | A1 | 8/2002 | Ciotti | |
| 2002/0149228 | A1 | 10/2002 | Lambright | |
| 2002/0185889 | A1 | 12/2002 | Hernandez et al. | |
| 2002/0194796 | A1 | 12/2002 | Kress | |
| 2003/0009954 | A1 * | 1/2003 | Bradley | 52/79.1 |
| 2003/0051417 | A1 | 3/2003 | Ciotti | |
| 2003/0115808 | A1 | 6/2003 | Morrow | |
| 2003/0159366 | A1 | 8/2003 | Christensen | |
| 2005/0150175 | A1 | 7/2005 | Guigan | |
| 2005/0262778 | A1 | 12/2005 | Allen et al. | |
| 2005/0284035 | A1 | 12/2005 | DeOvando | |
| 2006/0033358 | A1 | 2/2006 | Guidry | |
| 2006/0055193 | A1 | 3/2006 | Colborne | |
| 2006/0185262 | A1 | 8/2006 | Abler | |
| 2006/0225369 | A1 | 10/2006 | Napier | |
| 2007/0007794 | A1 | 1/2007 | Bertoch et al. | |
| 2007/0079573 | A1 | 4/2007 | Sarine et al. | |
| 2007/0107321 | A1 | 5/2007 | Sarine et al. | |
| 2008/0084089 | A1 | 4/2008 | Hanson | |
| 2008/0256878 | A1 | 10/2008 | Berns et al. | |
| 2009/0199492 | A1 | 8/2009 | Gibson | |
| 2009/0217600 | A1 | 9/2009 | De Azambuja | |
| 2009/0223143 | A1 * | 9/2009 | Esposito | 52/79.1 |
| 2011/0041415 | A1 * | 2/2011 | Esposito | 52/12 |

FOREIGN PATENT DOCUMENTS

| | | | |
|---|---|---|---|
| DE | 19501423 | A1 | 7/1996 |
| GB | 2411911 | A | 9/2005 |
| WO | 2007/012872 | A2 | 2/2007 |

* cited by examiner

SELF-CONTAINED STRUCTURE CONFIGURABLE AS A SHIPPING CONTAINER AND AS A DWELLING

PRIORITY

This application is a continuation of application Ser. No. 12/074,584 filed on Mar. 5, 2008, and claims the benefit of U.S. Provisional Application No. 61/241,178, filed Sep. 10, 2009, the contents of each of which are hereby incorporated by reference.

TECHNICAL FIELD

The present disclosure is directed to a prefabricated house and, more particularly, a transformable structure, which firstly transports all materials needed for the house and secondly is a prefabricated core which is embodied into the final house containing installed plumbing and electrical elements in partitioned spaces embodying at least one bathroom and a food preparation area. In addition the core may embody elements to enable sustainable, and off-grid living by harvesting rain for water, solar energy for power and heating, and a sanitary waste system. The structure in its dwelling configuration could also be supplied by an electric and water, sewer and other utilities.

BACKGROUND OF THE INVENTION

Prefabricated housing for dwelling is well known. Some prefabricated housing modules were factory built and transported to a local building site via truck trailer. These housing modules failed when competing with site built homes due to high costs and/or extreme designs.

More recent attempts have been made to overcome the associated high costs with early prefabricated housing in an effort to compete with conventional homes. These prefabricated housing systems were designed as wide-load truck size sections, which were joined on site. These designs suffered from drawbacks such as the shipping of empty space and the performance of extensive redundant site work to reconnect the modules and their associated components. These attempts, which have a limited delivery radius of a few hundred miles, also disadvantageously failed to achieve high volumes or mass production and failed to address the issues of very low cost, sustainability and worldwide distribution of housing units for residential dwellings. These attempts also do not provide a solution to the worldwide challenges of providing a domicile of shelter and safety for those in need of a home and especially in underdeveloped geographies. People living in underdeveloped geographies lack access to safe drinking water, basic sanitation, and have no access to grid electricity. Over one billion people have no access to clean water, or basic sanitation systems. Securing water has become a challenge in many parts of the world, and in part due to the withdrawing of more water from underground aquifers than can be replaced. Rainwater harvesting with basic septic sanitary systems on a house-by-house basis is a method that will make life sustainable throughout the world. In addition, manufactured housing to date has failed to consolidate demand and as a result is not able to take advantage of high volume mass production to reduce cost. Such limited regional use fails to capture adequate demand in volume to apply high technology solutions, such as robotic assembly lines, and mass produced sub-assemblies for the purpose of reducing costs. As a result, no known prefabricated manufactured housing to date has achieved an affordable solution in the context of worldwide need, let alone a sustainable, off grid solution.

Intermodal shipping containers bring goods to every corner of the world. Many cities include shipping ports that have the capability of handling these standard shipping containers. Standards are determined by the International Organization For Standardization (ISO), which is located in Geneva, Switzerland and publishes the International Standards. For example, four common container lengths include 10 foot (ft), 20 ft, 30 ft, and 40 ft. The 20 ft container is the most common length worldwide and the ISO provides International Standards for the 20 ft container. For example, such published ISO standards for a 20 ft container include a volume of 1,169 $ft^3$, a maximum gross mass of 52,910 lbs, an empty weight of 4,850 lbs, and a net load of 48,060 lbs.

Containerization is a system of intermodal freight transport using standard ISO containers. Such shipping containers can be transported by ship, rail, truck or air. However, due to the abundant use of these shipping containers especially in regions which do not export goods, the return of these shipping containers has become a drawback and must be figured into their cost.

Therefore, it would be desirable to overcome the disadvantages and drawbacks of the prior art with a single, self-contained dual use container/housing-core configured for containerization and also for related methods for construction of a dwelling, which efficiently utilizes the container and all materials, systems, spaces and equipment therein. Further, it would be desirable if the housing core and related methods and systems for intermodal freight transport provide low cost, sustaining domiciles of shelter and safety for those in need of a house in various geographies for worldwide distribution. It is most desirable that the housing core and related methods and systems of the present disclosure are advantageously employed to provide an affordable home that can be self-sustaining, and utilizes renewable energy and conservation techniques such that the home avoids drawing on non-renewable resources.

SUMMARY OF THE INVENTION

Accordingly, a self-contained structure configurable as a shipping container and as a dwelling is disclosed with related methods of construction of a dwelling and systems for intermodal freight transport thereof, which overcome the disadvantages and drawbacks of the prior art.

In one particular embodiment, in accordance with the principals of the present disclosure, a self-contained structure configurable as a shipping container and as a dwelling is provided. The self-contained structure configurable as a shipping container and as a dwelling includes a lower section including a platform and a floor, said lower section forming a first portion of a foundation of said dwelling; an upper section including a ceiling and connected to the lower section to define a cavity, said upper section forming a first portion of a roof of said dwelling; a plurality of wall components attached to said lower section and said upper section within said cavity to form subcavities within said cavity; a plurality of panels attachable to said lower section and said upper section to enclose said cavity when the structure is configured as the shipping container and attachable to said upper section to form a second portion of said roof of said dwelling extending from said first portion of said roof to define an approximate area of said dwelling when the structure is configured as the dwelling; and a plurality of extension walls storable within said subcavities when the structure is configured as the shipping container and configurable to enclose said approximate area of said dwelling when the structure is configured as the dwelling.

Also disclosed is a self-contained structure configurable as a shipping container and as a dwelling, including a core; building materials affixed to or contained in the core; wherein when the structure is configured as the shipping container, said core and building materials affixed to an exterior of said core comply with International Organization for Standards (ISO) standards for freight containers, and wherein when the structure is configured as the dwelling, using said core and said building materials, said dwelling comprises an area of approximately five-times an area of the core.

Further disclosed is a self-contained structure configurable as a shipping container and a dwelling, including a housing core, comprising: a first section including a floor and a first portion of walls; a second section connected with the first section to define at least one cavity, the second section including a ceiling and a second portion of the walls, the second section also including a reservoir; and a centralized sub core.

Still further is disclosed a method for intermodal freight transport of a structure configurable as a shipping container and a dwelling, including providing a housing core within the structure, the housing core including a first section, second section and a centralized sub-core; joining the first section and the second section to define at least one cavity configured for disposal of deployment items and loose items therebetween; transporting the structure via intermodal freight transport; and constructing a dwelling unit with the structure.

BRIEF DESCRIPTION OF THE DRAWINGS

The above and other objects, features and advantages will become more readily apparent from the specific description accompanied by the following drawings.

DETAILED DESCRIPTION OF THE INVENTION

Figure 1:
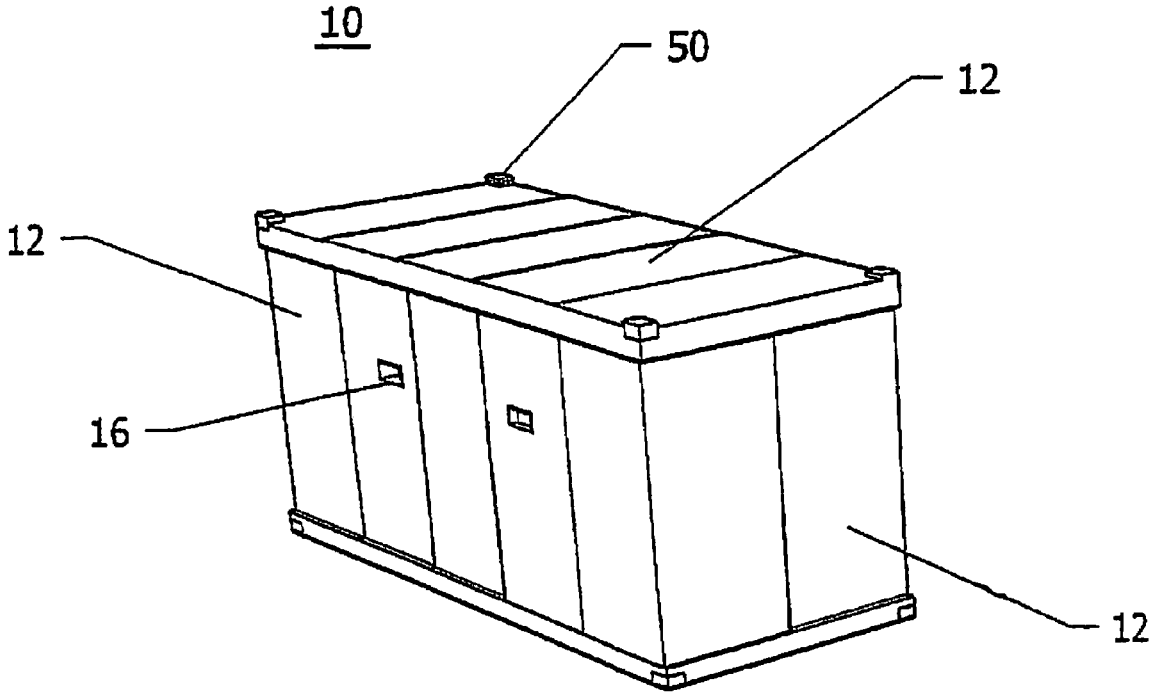
FIG. 1 is a perspective view of a self-contained structure configured as a shipping container in accordance with the principles of the present disclosure.

Detailed embodiments for the present disclosure are disclosed therein, however, it is to be understood that the described embodiments are merely exemplary of the disclosure, which may be embodied in various forms. Therefore, specific functional details disclosed herein are not to be interpreted as limiting, but merely as a basis for the claims and as a representative basis for teaching one skilled in the art to variously employ the present disclosure in virtually any approximately detailed embodiment. Like reference numerals indicate similar parts throughout the figures.

The structure includes a housing core. Desirably, the housing core and related methods and systems, provide low cost, sustaining domiciles of shelter and safety for those in need of a home and in various geographies for worldwide distribution. The housing core and related methods and systems may be advantageously employed to provide an affordable home that is self-sustaining, and utilizes renewable energy and conservation techniques such that the home avoids drawing on nonrenewable resources or the need to be connected to utility infrastructure. It is envisioned that the housing core may have wireless Internet access and/or land line Internet access. It is further envisioned that the housing core is easily and efficiently manufactured and assembled. In an alternate embodiment it is envisioned that the benefits of the subject invention advantageously utilizes efficient manufacturing, delivery and installation methods and that such dwellings may be fitted for use with conventional utilities and grid-tied infrastructure supplying electric power, water and sewer systems.

It is envisioned that the core includes all the mechanical, electric and hydraulic systems of the dwelling, as well as the spaces and fixtures to use these systems. The core needs little to no additional work on site for those systems to function. It is contemplated that the core is a rigid, reinforced structure, which provides lateral stability to the construction of the dwelling. This is advantageously enhanced by the construction of a rigid roof using development items (e.g.—beams and panels). This rigid flat plane roof is laterally braced by the core and extends lateral stability to exterior walls. Alternatively, the roof could be a fabric, suspended between the rigid core and columns or other structural elements.

The structure includes a housing core. The housing core includes a first section having a floor and a first portion of walls. A second section is connected with the first section to define at least one cavity. The second section includes a ceiling and a second portion of the walls. The second section also includes a reservoir, such as, for example, a water tank.

Deployment items such as, for example, a roof membrane and installed components such as, for example, refrigeration units are disposed in the at least one cavity of the first and second sections. Implants are disposed within the first and second sections. The implants may include high pressure laminate floor surfaces, plumbing pipe trees, electric harness and receiver fittings, etc. Incidental or loose items such as flooring, for example, carpet and Portland cement, are disposed with the first and second sections.

The first and second sections may be injection molded. The sections may also be manufactured by other methods. The first section may be configured as a lower half and the second section may be configured as an upper half. The first and second sections may be fabricated from plastic, wood, steel and/or aluminum. The housing core may have a cross-sectional I-beam configuration to provide strength.

It is contemplated that the structure complies with ISO standards for freight transport, via any or all methods. It is further contemplated that the housing core can be configured for standard containerization of a 20 ft high cube container and/or stand-alone operation and terminal handling.

Alternatively, the housing core includes water conservation components and/or recycling components. The reservoir is configured to collect natural elements and be located in an advantageously strategic position of the core. The housing core can include loose items being disposed in the at least one cavity of the first and second sections. The housing core can include installed components disposed with the first and second sections. The deployment items include a septic system.

The at least one cavity is configured to support materials for exterior enclosure walls. The walls are constructed to enclose additional living space outside of the dimensions of the core. Such walls may include exterior doors and windows and can be configured to be transported within the plurality of cavities created in the core. Such prefabricated wall panels, being non load-bearing, may be divided into an upper and a lower section having an offset jointing detail which would allow vertical movement between the two sections. This arrangement would prevent binding and buckling which would otherwise damage the panels and or windows in the event of vertical forces such as may be caused by seismic loads generated by earthquakes.

In addition to the exterior wall panels the housing core may include panels configured to protect the housing core during transport. The panels are removable from the housing core to form a portion of the roof extending from the housing core to enclose additional space outside of the core. The structure is configurable into a dwelling and provides immediate lateral stability for the dwelling.

The housing core is designed to provide the aspects of a shelter in a package that can be deployed by an unskilled worker, or an end user of the dwelling. The house core can be a combination of factory built mechanical and electrical systems coupled with local construction of the shell or enclosure with materials provided or from other sources.

For example, the housing core may include a solar photovoltaic, or other system such as a wind generation system, and it is envisioned that such a power supply is sufficient to provide energy for refrigeration, pumps for water management, light and internet capability. The need for battery storage can be minimized by cycling energy use and conservation techniques. Other renewable power sources are contemplated.

The housing core provides a dwelling, which includes rain harvesting and water management. Even in semi-arid grassland areas, adequate rainfall can be harvested and stored by the components of the housing core to get through dry seasons. A rain harvesting area or water tank of the housing core is contemplated for each unit. For example, the housing core can include a rain harvesting area, which is approximately 1000 square feet with primary storage of about 1000 gallons and secondary storage as needed depending on rainfall and frequency. Integrating rain-harvesting elements into the design calls for the roof to drain water into settlement troughs which then delivers the water to the main storage reservoir. In addition, the exposure of the shallow reservoir to the sun can advantageously collect additional energy in the form of heat stored in the water of the reservoir. Additionally, water from the settlement troughs can be circulated onto solar panels and roof surfaces cooling these elements at critical times, causing an increase in efficiency and comfort. The water management of the housing core may include recycling water, specially designed fixtures, bathing and laundering techniques, etc. Alternatively, sanitary disposal of waste is achieved by specially designed deployment items such as, for example, septic systems designed to safely return effluent to the earth.

The dwelling can provide about 20 gallons of water per day which can be collected from as little as 12 inches of rain per year, and this amount can be supplemented by other methods. Purification methods are well known and can be implemented with minimal electric power, if any.

The structure may be configured to provide dwellings for rural areas whereby population densities are low. Alternatively, the structure may be utilized with areas having densities of 12 or more housing cores or about 70 or more people per acre. It is contemplated that the housing unit, i.e. the expanded housing core, can include sufficient living space to house a single family, an extended family or even two families.

In one embodiment, the housing core is configured as a one-story structure. The housing core can effectively harvest rainwater and solar energy, and needs no infrastructure. It is envisioned that a plurality of housing cores may be employed in other configurations such as two-story, three-story and/or multiple story structures. In an alternate embodiment, the housing core(s) may be utilized for small schools and medical centers. Walls may be built with indigenous material, which could be customized to fit specific requirements. Multiple cores could be linked for larger structures.

Alternatively, each housing unit can be constructed with compacted earth foundations and floors, such methods are well documented and have been used for thousands of years and continue to be serviceable today as in the floors and foundations of Greek and Roman times. The housing units can be constructed on platforms or on floor slabs and foundations made with modern concrete.

The structure design utilizes a system, which is a component for worldwide delivery. This advantageous system eliminates disposal or returning empty space. In one embodiment, the housing core is transported as a 20 ft container and meets ISO standardized dimensions and specifications. It is envisioned that the relatively small size of the housing core, along with its stackable and weatherproof handling capabilities, allows stockpiling of multiple housing cores at a storage facility. It is further envisioned that a plurality of housing cores, including thousands of units, could be distributed domestically and throughout the world. For example, such housing cores can be shipped by relief agencies to alleviate displaced persons because of natural disasters or to be received by communities in the process of building new communities or can be used by an individual.

Advantageously, the containerized housing core does not require opening until it reaches its desired final site or transport destination. Once dispatched to a desired location, or shipped to a predetermined geography, all portions and/or components of the containerized housing core are used to complete the housing unit or dwelling. In one embodiment, an outer protective skin of the housing core includes panels, which can be removed at the transport destination. The panels may be used as a roof deck of the housing unit upon which a waterproof membrane is disposed. The housing can include reinforced structural elements, employed for shipping and stacking, to form the structure of the housing core. The core provides rigidity and lateral stability for the expanded dwelling, which allows for facile on-site assembly. The housing core configuration minimizes packaging waste, and no container or portion of a container needs to be returned as it is all used in the final dwelling. Bathroom spaces, mechanical systems and photovoltaic systems, including walls incorporating them, are constructed, assembled and completed prior to shipping and/or transport.

Within the structure, the remaining volume is packed with prefabricated materials for the completion of the dwelling unit. Wall panels including windows and doors, also packed within the housing core, are deployed once the housing core is disposed at its desired location and the dwelling, which includes the housing core, is completed at the final site.

It is envisioned that the containerized housing core meets the standards of design, and delivers comfort and livability to users of diverse cultures, economic status and geographic location.

In another embodiment, a method to construct an affordable, adequate house is provided.

An adequate house should be appropriate for the typical size family, which varies and depends upon, among other things, the culture, the wealth and the community. The birth rates throughout the world range from 2 to 5 children. To create adequate space would require 2 to 3 separate sleeping spaces and at least one bathroom with an accommodation to clean clothing. A food storage and preparation area, as well as a consumption area would be required. Also a common living area large enough for family interaction, learning and entertaining is needed. In order to capture the largest possible market to increase the manufacturing volume, the house should also be able in some cases to house an extended family (the most common being mother and daughter with children), or possibly two families with or without children. In extreme conditions, it may be possible and more economical to have two families reside in the same house, but this would require another bathroom and a reasonable separation of at least the sleeping areas.

As an example, minimum space for these functions would be 40 sf bath, 120 sf sleeping areas, 180 sf food prep and consumption, and 160 sf common area. Add about 100 sf for circulation and storage, and we get a house of about 800 square feet. Space is like air, humans need what they need. It is contemplated that this house be distributed widely around the world, and in contrast to other failed efforts which have proffered affordable housing that is inadequate in space, it is a specific goal that the present invention contain adequate space.

Affordability is relative, and in calculating a target we must consider all costs over the life of the house which includes necessary utilities and maintenance. Land costs cannot be addressed here, as they can be very expensive or can be free, loaned to those who need. The design, however, demonstrates a potential density that makes efficient use of land. This will be of paramount importance and will affect the diversity, community services and costs of commuting. With much of the world earning only a few dollars per day, rather than trying to define a number that is affordable, let us go with what is adequate and we must minimize the cost in every way possible.

The present invention can achieve a large market segment, with large volume to maximize buying clout and eliminate middle men, buying materials from primary suppliers; materials should be carefully selected for ease of use and low maintenance, should be delivered to the factory on a 'just in time' basis and should strive to eliminate unnecessary packaging costs; factories should be located to reduce shipping costs of suppliers' materials and components; volume should be consolidated to take advantage of the most advanced mass production technologies of the product should anticipate techniques to reduce shipping costs and must fall into the standards of containerization; maximize 'sweat equity' on the part of the end user at the final building site; many of the people who need this home have time to work but no productive job; they need to be able to help themselves by adding their labor to the home construction; in order to do this the design must eliminate the need for specialized labor (such as electrical and plumbing work), special tools or equipment and eliminate the frustration of material shortages; incorporate sustainable technology to reduce and/or eliminate required utility costs; invent new conservation technology to reduce the needed quantity of energy and water; target the moderate climates to take advantage of the mild temperatures and eliminate the need for heating.

Many efforts have attempted to bring the construction of the house into the factory. Whether the systems called for all or part of the house to be factory built, none of the efforts succeeded in developing a high enough demand to reduce the cost to a level that would make a significant difference, or could penetrate beyond regional markets. These attempts have failed because of several reasons; some examples follow.

The first system fully builds the house in the factory, complete with exterior walls and roof, plumbing and electrical, and all finishing materials. Only the foundation is built on site. These houses are built in sections (2 or more) in the factory and the shipment is mostly empty space, the sections are often extra wide needing special escorts or permits to move the sections over the road. Once the sections are delivered to the site, electrical and plumbing must be interconnected, requiring special labor (plumbers and electricians). The over-sized sections and their corresponding difficulty to transport them cause a limited size market to be served. Generally these sections can be shipped only within a few hundred miles, and beyond that it is not cost effective. The small market area served results in a low volume level that cannot justify the capital investment needed for high, robotic automation. Consequently the process to build these homes in the factory is basically the same as that used in conventional, tedious on site construction. In addition the small volume precludes cost efficiencies that could be had for high volume purchasing and often results in purchasing from distributors, introducing another profit center into the supply chain. With a larger volume new innovative, cost saving developments, use of new materials and capital investment to develop these techniques is justified. These houses cost more than $80,000, and though this may seem affordable in the US or the rest of the wealthy world, it is clearly not affordable to most of the people on earth.

Another class of factory built affordable housing consists of systems that enclose space, generally with wall and floor panelization, but do not address the plumbing and electric needs of the home. These are inadequate houses that are merely shells that screen out the elements. Needed amenities of bathrooms and kitchens now become a local site built process that defeats the cost savings of the factory built shell. The most skill dependant, difficult and expensive materials portions of the house are left to be cut into the prefab panelized system. These systems do not allow a house to be completed by unskilled labor. Some of these systems were viewed as housing for the very poor, and were designed to be too small to be considered adequate housing.

Another approach is to utilize new or used shipping containers. Many of these designs use several containers (20 foot containers have 160 square feet of space) to create a house of adequate size. These attempts have not been successful. The 8-foot width, common to all containers, is extremely limiting forcing these systems to join several containers which are modified, at great expense, to create an adequate house. The extent of reworking the containers is costly and redundant. The cost of shipping an adequate (800 square feet) house is high since this would require transporting about 5 twenty-foot containers mostly filled with nothing but air. The cost of providing and interconnecting the electric and plumbing system thru multiple containers is high and difficult to achieve in the factory because they require many couplings.

The embodiment described here is a better way to build an affordable, adequate house. The concept of designing an adequate house to be built in a factory starts by consolidating all the mechanical and electrical systems into a center core, which not only contains the plumbing pipes and electric wires, but also the spaces and fixtures needed to complete the bath and kitchen functions. Only if the appropriate wall and floor surfaces as well as appliances and the finished hook-ups of fixtures are contained within a single core could they be completed in the factory. Some of the advantages are described as follows: the proximity of all systems requires less wire, less pipe, and less power; eliminate on site couplings; eliminate the need for special labor or tools; eliminate the need for securing specialized parts; bring the most advanced materials and systems with the core shipment and have them prefabricated for ease and speed of installation.

The size of this core now starts to be defined as at least large enough to contain the two baths and the food preparation and appliance area of the 'adequate house'. In order to transport the core efficiently its size must be small enough to fit into the international transportation system of the world (to capture the largest market and volume possible). This is defined and specified as cargo containers by the ISO or International Standards Organization. These containers, which can travel by ship, truck, rail or plane, are limited to 8 feet in width and standard lengths are 10, 20, 30 and 40 feet. Since the cores would normally be delivered to its final site by truck, the length of whose trailers are most commonly 48 and 53 feet long, it reduces delivery costs if a truck can carry as many cores as possible. Since 10 foot could not fit the two baths and food counter, and the truck could only carry one 30 or 40 foot container, the 20-foot container is the cost effective choice.

However another consideration for the size of the package is what should be the additional contents of the core. The goal here would be to make efficient use of the transport of the core (i.e. do not ship empty space) and to provide everything needed to complete the house, and to have this material prefabricated to maximize the cost effectiveness of the house. This set of materials can include: roof beams, decking and roofing membrane; exterior wall panels with screened windows and doors; Portland cement; solar photo-voltaic (PV) panels; sanitary system including septic tank and leeching system.

To include these items within the core and still keep within cost effective requirements that the core contain not only the fixtures but also the walls and space of the "mechanical rooms" was resolved by several unique and innovative methods. In addition a rainwater harvesting system is needed, as there is no lack of documentation that clean water will be an issue in much of the world now and into the 21st century.

Many of the prior core systems stopped short and were not successful because they simply did not do enough to satisfy the needs of a person who must help himself with sweat equity and because they did not cost effectively supply the balance of the components. It is part of the innovation and invention that this could be done within the space and containment of a single 20 foot container. In addition the problem of containerization is that the cargo containers must be returned, however the construction and solution of the challenge will be seen to be solved without the need to return a container as it will be completely used effectively in the construct of the house.

The disclosure includes the use of conservation technology, off-grid photovoltaic solar systems and water harvesting that reduce the operating cost of owning a home both to the owner and to the environment. These concepts and integration into the design help make this system sustainable and affordable.

Conservation technology is the use of resources, power and water in this case. Over the years with energy and water being relatively cheap and abundant the modern world has not conserved these, and has to an extent wasted them. The design of the core with sustainable solar power and a limited amount of rain water to harvest must find new ways to manage these limited resources such as: recirculating showers, reused grey water, super insulated top opening refrigerators, convection and induction cooking, cooling for roofing membranes and roof decking. Management of water and power can make the user actively aware of the level of his stored or available resources.

Photovoltaic solar panels, electric storage and power management will be designed and completed and tested in the factory. It will be successful because of the proximity of the collectors and storage batteries to the major loads. Appliances will be voltage matched and made more efficient than current products. The fact that these panels and related integrated systems are designed into the core in such a way that they need no installation expertise or effort in the field is the delivery invention that will make this house cost far less than others.

The successful factory built home addresses the reasons that have made prior attempts fail. It provides new innovation and invention and recognizes and respects the practicality needed to succeed. The disclosure uses proven systems and technology but consolidates, produces economically and delivers them to any location in the world. The method to build this core includes a platform (or chassis) formed of a metal frame made to the size and strength necessary to support the many loads which will be imposed upon it. In assembly line fashion upon this platform all the components for mechanical systems as well as walls and floor surfaces needed to enclose space and hold electric and plumbing pipes would be assembled. Next a ceiling system suitable for holding the rainwater reservoir and the PV solar panels would be added.

The overall framework of the core would hold the required corner fittings at the precise dimension and location required by the ISO standards. The many dimensional demands on the design of the core i.e., accommodating ISO specs, bath sizes, space to transport beams, panels, tanks and doors and windows, as well as installed appliances and fixtures are discussed below.

There are several innovations in the design enabling all the needed components to fit within a single 20 foot container. In addition the dimensions of the container serendipitously work into the house requirements. The beams are best supplied as a single span beam reaching from the independently laterally stable core (because of its structural framework and its cubic dimension) to the exterior walls. These beams would be transported in the longest continuous space of the container which occurs in the upper section, acting firstly to transport such beams and secondly as the water storage reservoir. In the dwelling unit these beams would span from the long edge of the core to an also supplied post and beam structural arrangement at the exterior wall furthest from the cores' long edge, this occurring on both sides of the core. Upon the deployment of these beams the water reservoir becomes available to accept water, the beams forming the structure for the roof deck, which holds the membrane which collects and directs the rainwater firstly into the trough and then into the storage reservoir.

The core, being shipped as a cargo container, would need protection and closure. By shrinking the size of the core by 2 to 4 inches in each direction, yet still maintaining the exact position of the corner fittings required by ISO, panels could be fitted on the 4 sides and top protecting all the contents within. Each layer of about 600 square feet would firstly be used to protect and enclose the core during transport and secondly, once removed, used to create the roof deck surface required to support the pre cut roofing membrane. This membrane would be installed into the side walls of the water reservoir trough ready to be rolled out onto the roof deck and funnel rainwater into the troughs and storage reservoir.

It is estimated that of the approximately 1500 cubic feet of the high cube container/core 90 to 95% of this volume is used to transport needed materials. The compaction of a full size dwelling, which contains about 8,000 cubic feet in its final form, into a single transportable container of 1500 cubic feet produces inherent cost savings in transportation costs. Additional savings in material handling and redundant packaging cost both coming into the factory and onto the building site would be achieved. Also volumes of materials could be bought directly from manufacturers, just in time, with no middlemen or distributor profits to pay. Cost savings would be achieved by completing much of the installed work in the factory, as opposed to on the building site.

The exterior walls are provided in the containerized core in several cavities formed by the upper and lower sections. The one of these cavities are firstly used to hold and transport the exterior wall panels, which may contain windows and doors within them, and secondly acts as an entry vestibule and corridor of the dwelling which connects the two expanded sides of the dwelling. Another such cavity firstly stores wall panels and secondly acts as the food preparation surface, or useable counter space in the core. Another cavity firstly stores a lightweight polymer septic tank and secondly becomes the large bathroom. Such septic tank could be drained by leaching fields or by small diameter effluent pumping as is known in the art.

It is contemplated that the structure is a transport mechanism for materials required for the construction of the dwelling.

The exemplary embodiments of a self-contained structure configurable as a shipping container and as a dwelling and related methods of construction for dwellings and systems for intermodal freight transport thereof are disclosed and discussed in terms of prefabricated housing and more particularly, in terms of low cost, sustainable dwellings and domiciles of shelter and safety. It is envisioned that the advantages of the present disclosure may be utilized for the benefit of those in need of a home and in various geographies. The structure may be configured for domestic, regional and/or worldwide distribution. It is envisioned that the present disclosure may be used with a range of applications including those employing renewable energy and conservation techniques. It is further envisioned that the structure is configurable to form a dwelling, which is designed to provide a shelter in a package that can be deployed by those at various skill levels including the most basic such as the end user. The structure may also include components addressing needs such as personal cleanliness, food storage and preparation, and education, and may include water supply, power supply, Internet and sanitation. The structure can be factory built including mechanical and electrical systems, and coupled with the local construction of the shell or exterior walls of the dwelling unit to create a complete dwelling unit.

It is also envisioned that the structure may provide the foundation for a single dwelling unit, combined with other structure(s) as a plurality of dwelling units and constructed together as a multiple dwelling unit and/or constructed as a plurality of units or plurality of multiple dwelling units to form a community configuration. It is further envisioned that the structure of the present disclosure may alternatively be used with existing or constructed on site utilities such as appropriate water, sewer and power supply as provided by a local or regional utility and connected as is known to one skilled in the art.

The following discussion includes a description of a structure, related components, assembly of the containerized unit, containerized transport of the housing core, and exemplary methods of constructing dwellings including the housing core in accordance with the principles of the present disclosure. Alternate embodiments are also disclosed. Reference will now be made in detail to the exemplary embodiments of the present disclosure, which are illustrated in the accompanying figures.

Turning now to FIG. 1, there is illustrated a perspective view of a self-contained structure 10 configured as a shipping container in accordance with the principles of the present disclosure.

The components of the structure 10 are fabricated from materials suitable for prefabricated housing, such as, for example, wood, compressed particleboard, metals, plastics and/or other materials, depending on the particular application and/or preference of the manufacturer and/or end user. Semi-rigid and rigid plastics as well as foam plastics are contemplated for fabrication, as well as resilient materials, such as rubber. The frame, walls, plumbing, circuitry, and interior fixtures of the housing core may be fabricated from those suitable for a dwelling and/or shelter application. One skilled in the art, however, will realize that other materials and fabrication methods suitable for assembly and manufacture, in accordance with the present disclosure, also would be appropriate.

Figure 2:
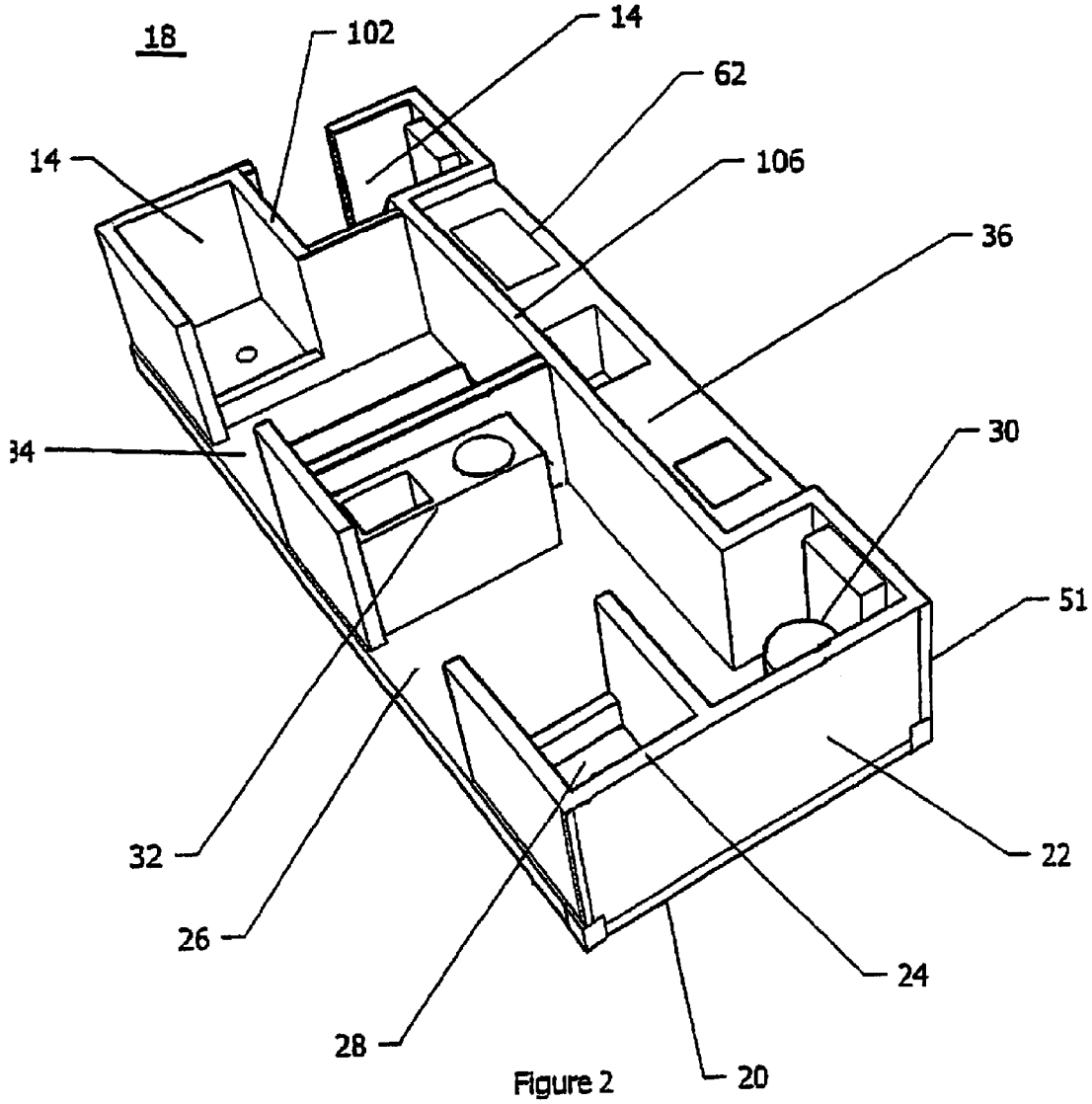
FIG. 2 is a perspective view of a first portion of a housing core of the structure.
Figure 3:
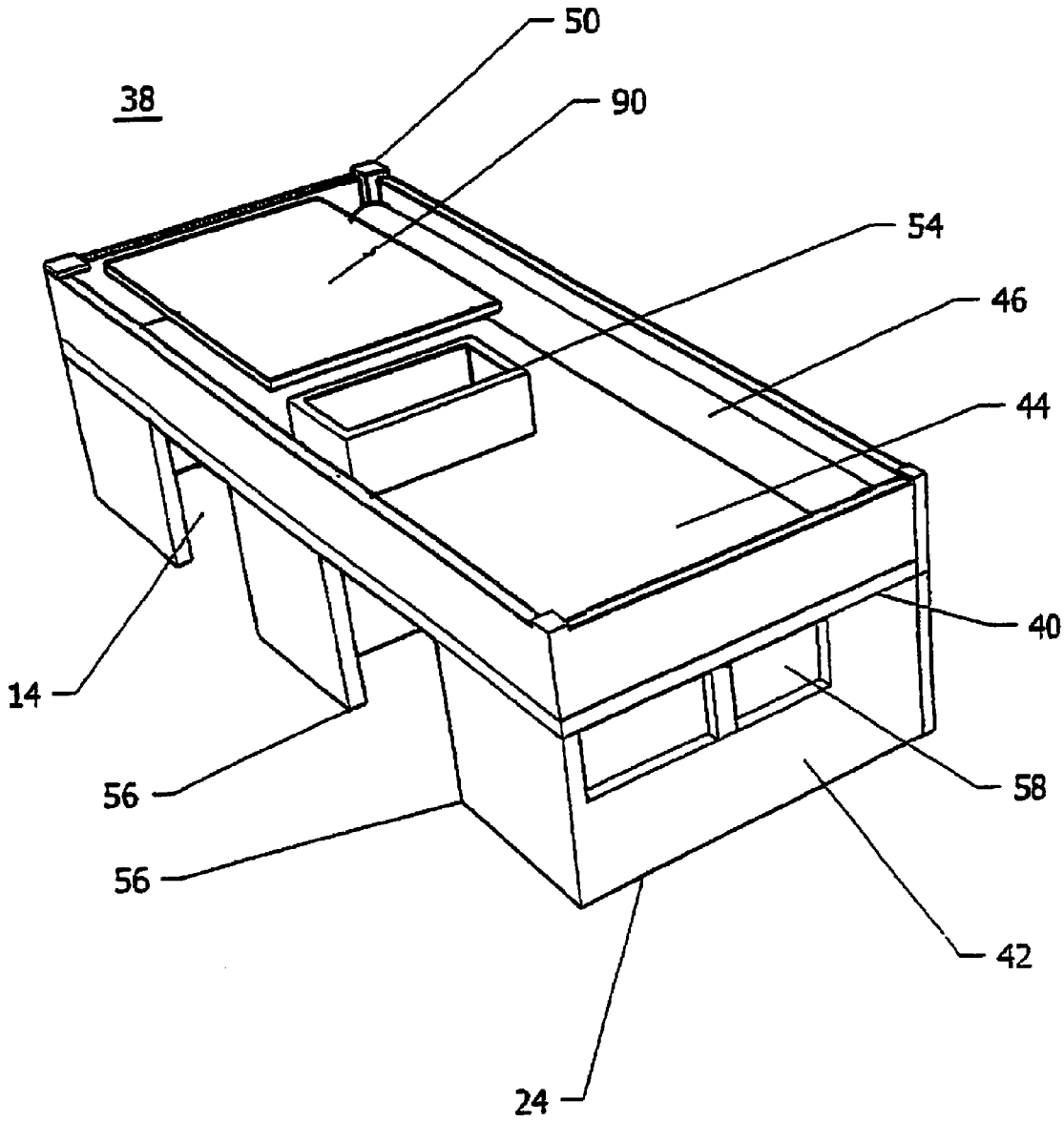
FIG. 3 is a perspective view of a second portion of the housing core of the structure.
Figure 3A:
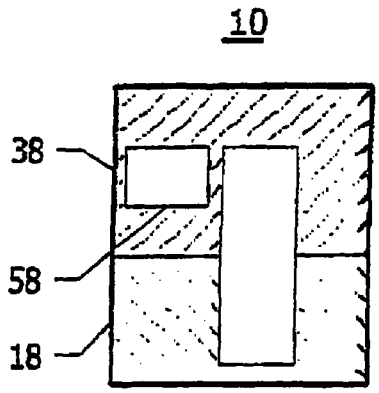
FIG. 3A is a side elevation view of the housing core of the structure.
Figure 3B:
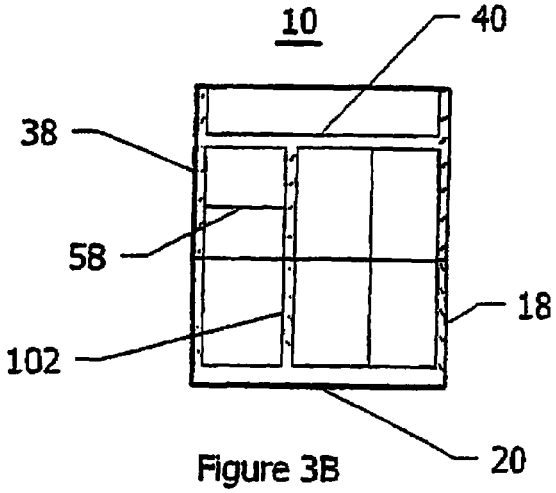
FIG. 3B is a cutaway view of the housing core shown in FIG. 3A.
Figure 3C:
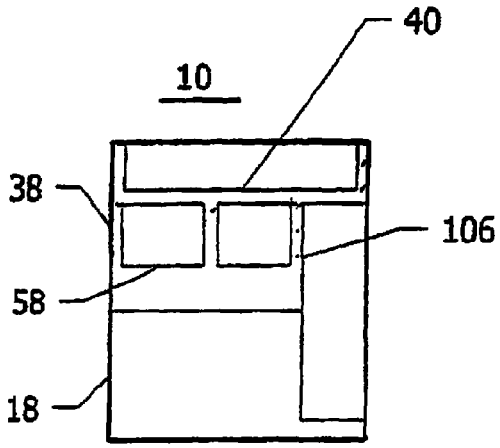
FIG. 3C is a cutaway view of the housing core at the center shown in FIG. 3B.
Figure 3D:
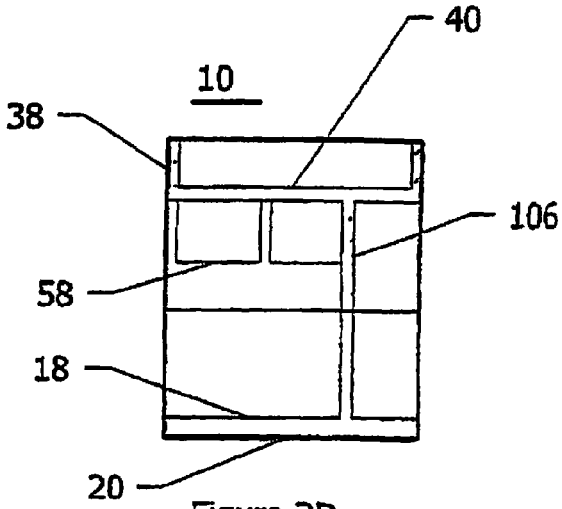
FIG. 3D is a cross-section view of the housing core shown in FIG. 3C.

Referring to FIGS. 1-3, structure 10 is configured for transport as a 20 foot intermodal container, which is handled and stacked as a standard container pursuant to applicable ISO standards, which are known to those skilled in the art. At the desired location or final building site, the entire container and components of structure 10 will be used for construction of the dwelling unit. For example, structure 10 is transported in containerized form having approximate dimensions, 20'×8'×9'6". It is envisioned that other sized container dimensions, such as 10 ft, 30 ft, and 40 ft, may be employed including custom configurations.

Structure 10 includes panels 12 used to protect structure 10 and its components. Panels 12 are configured as an outer cover or protective skin for housing core 10. Panels 12 are removed at the final building site and reused for construction. For example, panels 12 may be reused to construct roof 86 (FIG. 5) of the dwelling unit for structure 10. Panels 12 may be used to construct other portions of the dwelling unit. Panels 12 are rectangular in configuration; however, other shapes are also envisioned such as, circular, triangle, etc.

Panels 12 include access cavities 16, which communicate in between cavity or cavities 14, discussed in more detail below, of structure 10. Cavities 16 are configured for receipt of the forks of a forklift (not shown) or to allow inspections or viewing to the interior. As such, structure 10 can be easily maneuvered and inspected for shipping and storage. It is envisioned that structure 10 may not include cavities 16 or include a single cavity 16, or multiple cavities 16.

Structure 10 can include an injection molded first section, such as, for example, a lower half 18, as shown in FIG. 2, including a floor 20 and a first portion, such as, for example, lower portion 22 of walls 24. It is contemplated that lower half 18 may be formed, alternative to injection molding, by various fabrication methods such as manual construction, machine forming, vacuum forming, etc. Floor 20 may include a platform, poured foundation, etc.

Lower half 18 includes a first bathroom 26 with a shower 28, a toilet 30 and sinks 32. Lower half 18 also includes a second bathroom 34 with similar components, and a food preparation area 36 with sinks, countertop, etc. It is envisioned that lower half 18 may have various component configurations, such as a single bath, alternate counter design, closets, showers or bathtub arrangement and alternate access openings, and separate toilet rooms.

Structure 10 includes an injection molded second section, such as, for example, an upper half 38, as shown in FIG. 3. Upper half 38 is joined with lower half 18 to define a plurality of cavities 14. These cavities 14 define space to accommodate disposal of various items, discussed below, as well as rooms, cabinets, fixtures, appliances, etc. of the dwelling unit including structure 10.

Upper half 38 includes a ceiling 40 and a second portion, such as, for example an upper portion 42 of walls 24 separating the core into two halves. Upper half 38 includes a reservoir, such as, for example, a water tank 44. It is contemplated that upper half 38 may be formed, alternative to injection molding, by various fabrication methods such as manual construction, machine forming, vacuum forming, etc. It is further contemplated that housing core 10 may be formed as a single structure such that the first section and the second section are connected and subsequent joining of the halves is not required. The first section and the second section may be monolithically formed, integrally connected, etc. It is envisioned that the reservoir may be configured to support other fluids in multiple compartments and/or other materials.

Referring to FIGS. 3A, 3B, 3C and 3D, the arrangement of cavities disposed with structure 10, walls 24 and floor 20 are designed to achieve the maximum strength for each molded half 18, 38. Both upper half 38 and water tank 44 of upper half 38 are reinforced by vertical ribs disposed along structure 10 in both directions. Structure 10 includes walls 102 (FIGS. 2 and 7) of the toilet and bath enclosure as well as a longitudinal rib 106 disposed adjacent food preparation area 36. When halves 18, 38 are joined, the resultant section is an I-beam configuration with web 106 such that reinforcing ribs support the top 40 and bottom flanges 20. The connection between upper half 38 and lower half 18 is proximate to the neutral axis of structure 10 and be staggered or offset where the stresses are minimal. Walls 102 create additional reinforcing such as by creating box beam cross sections.

The ends of structure 10 are solid (FIG. 3A) as is the center cross section (FIG. 3C) and corners 51, which can be further reinforced, to accommodate the handling and lifting stresses applied to structure 10 during movement and handling. These stresses distribute through I-beam configuration (106+20+40) (FIG. 3D) of structure 10, as well as exterior panel 12 cladding, which is in place when lifting occurs. I-beam configuration (106+20+40) also provides support for internal connections, walking surfaces and attachment points of structure 10 for reinforcement for day-to-day loads applied to structure 10 and its components. This configuration also creates lateral stability, which facilitates construction of the completed dwelling. Reinforcement can be incorporated into structure 10 to accommodate stresses in an efficient manner.

Figure 4:
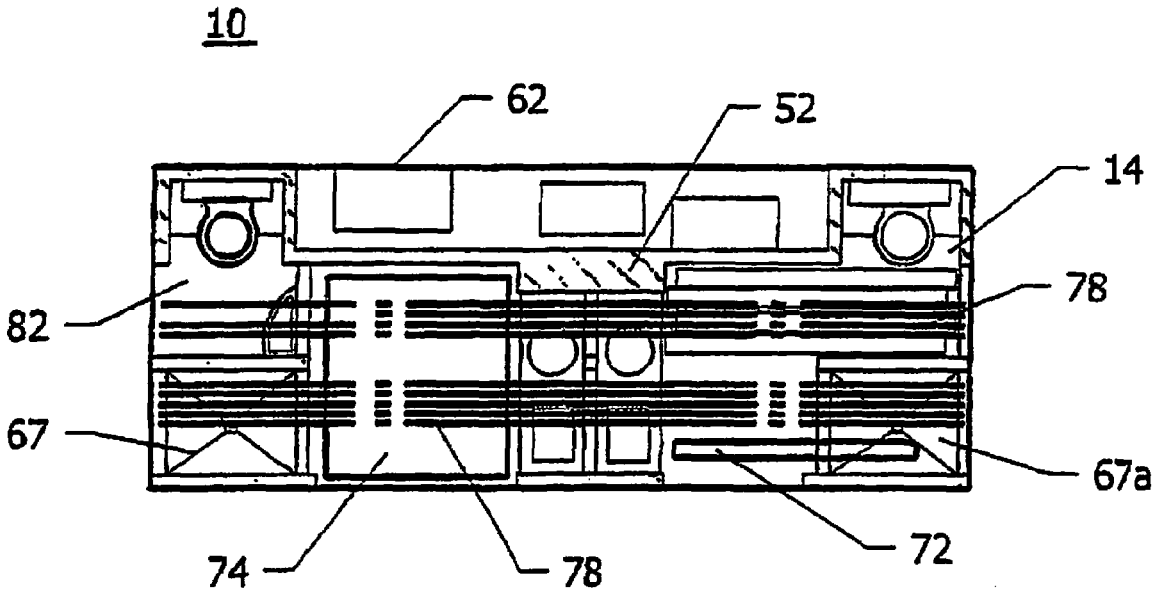
FIG. 4 is a top cutaway view of the housing core of the structure.
Figure 4A:
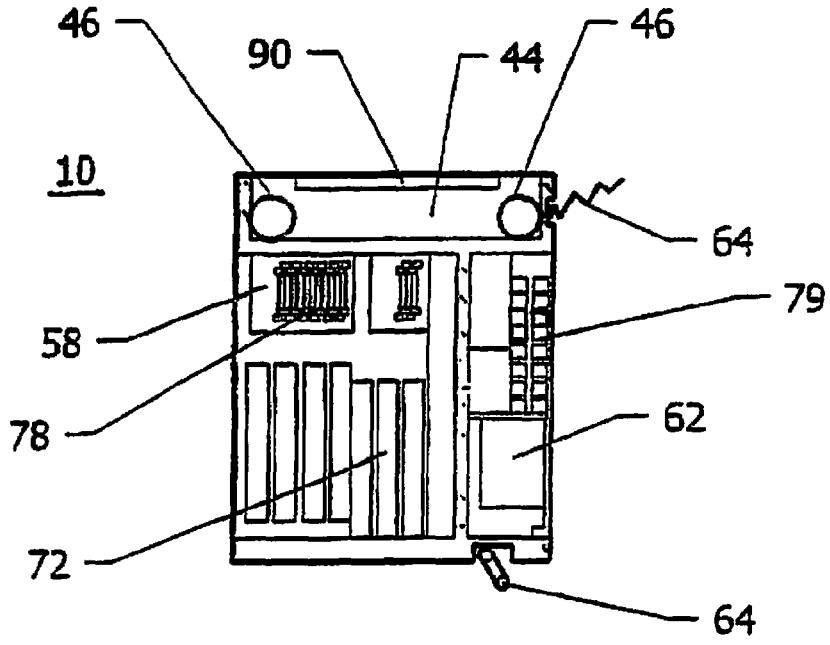
FIG. 4A is a side cross section view of the housing core shown in FIG. 4.
Figure 5:
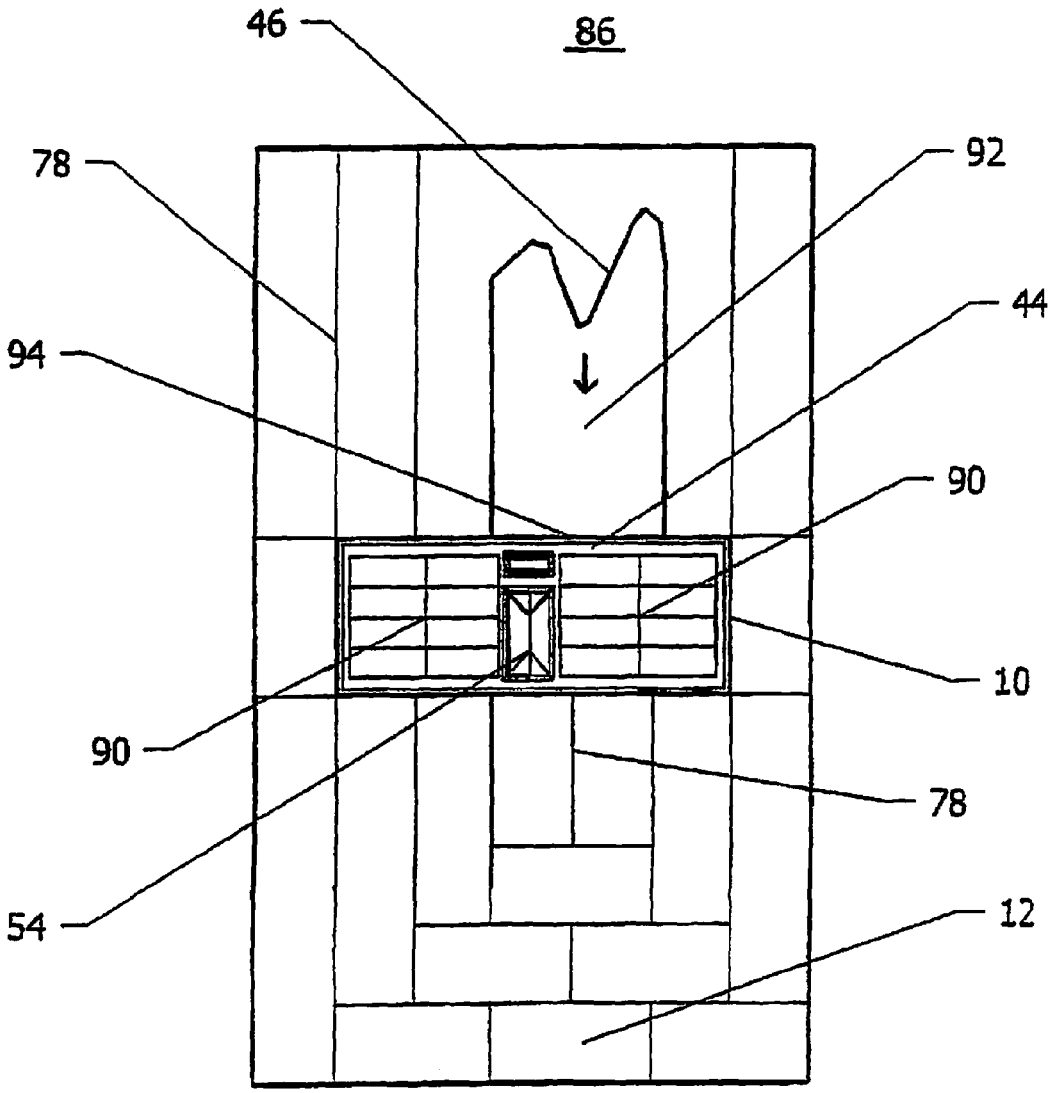
FIG. 5 is a top plan view of the roof of the self-contained structure configured as a dwelling.

Referring to FIGS. 4, 4A and 5, beams 78 are used for the structural framing of roof 86. These beams 78 can be placed below ceiling 40 and run the length and the width of structure 10 through aligned openings 58. Access through ports 16 allows a forklift type machine to lift structure 10 utilizing the strength and placement of beams 78 to position it into its final prepared site.

Upper half 38 stores a roofing membrane 46 to be deployed out on the deck of roof 86. Upper half 38 includes intermodal corner fittings 50 and photovoltaic panels 90, which is installed or stored with structure 10 prior to transport. A natural light and ventilation shaft 54 may be disposed with ceiling 40. Upper half 38 also includes openings 56, which facilitate alignment of portions 22 and 42 of walls 24. Openings 58 of upper half 38 facilitate loading and unloading of beams 78 for roof 86. It is envisioned that upper half 38 may have various component configurations, such as alternate opening disposal, and provide storage for various items. Roof 86 may be constructed from various materials.

Deployment items and installed components, as will be discussed in further detail below, are disposed with lower half 18 and upper half 38. Implants are disposed within lower half 18 and upper half 38 and are included in the molding process. Implants include high-pressure laminate floor surfaces, plumbing pipe trees, electrical wire harness, and receiver fittings, etc. Incidental or loose items are also disposed with lower half 18 and upper half 38, in spaces such as 14, 67, 67*a*, 44 and 82.

Structure 10 is a system, which facilitates transport and storage of its components. The components are used for the construction of the corresponding dwelling unit using structure 10. It is contemplated that components may also be disposed in shower stalls 67, 67*a* of baths 26 and 34, respectively. In its containerized form in preparation for transport, structure 10 has first bathroom 26 and second bathroom 34, which define suitable bathing and toilet spaces for use. Each bathroom 26, 34 may have natural light and ventilation, as shown in FIG. 3. Each bathroom 26, 34 may be variously configured and dimensioned with structure 10. For example, each bath may be approximately 50 square feet in floor space. It is envisioned that food preparation area 36 has a 13 foot long counter with cabinets and appliances. Water tank 44 and photovoltaic solar array 90 may be built in with ceiling 40. Water and electric systems along with their fixtures are disposed within structure 10 and are installed prior to transport.

It is envisioned that water tank 44 is a primary water reservoir, however, structure 10 may include a secondary reservoir, or a plurality of reservoirs.

In containerized form in preparation for transport, structure 10 includes exterior windows and doors 72 disposed within the space and area of cavities 14 defined by first bathroom 26. It is envisioned that 8-10 windows/doors may be disposed therein.

A septic tank 74 is disposed within the space and area of cavities 14 defined by second bathroom 34. It is envisioned that septic tank 74 is approximately 900 gallons although other sizes are contemplated. A back up battery 52 is stored within structure 10.

In one embodiment, aligned openings 58 provide access for placement and transport of beams 78. For example, multiple beams 78, which are full length, for example, 19' 6" long, can be stored over or through shower stall 67 and 67*a* and extend the length of structure 10. Beams 78 can be accessed for loading and unloading through aligned openings 58. Beams 78 may be stored at an area just below the ceiling of first bathroom 26 and through second bathroom 34 with access through aligned openings 58 and above windows 72 and tank 74. Branches 64 extend electric and waste water hook-up to septic tank 74, and electric to spaces 100, are also included with structure 10.

The advantageous design of the present disclosure does not require installers skilled in the art of electrical or plumbing. If the final site is in a region where additional heating is required, this can be provided through a separate heating system of structure 10 such as additional thermal solar or conventional boilers, which can be included as a loose item. Such loose items can vary in style depending on climate.

In another embodiment, a method for intermodal freight transport of structure 10 is provided. This method includes the steps of providing structure 10, which includes lower half 18 and upper half 38. The molded shell or lower and upper halves 18, 28 of structure 10 enclose and support the integrated systems for the dwelling structure employing structure 10, which are installed prior to transport.

The shell of structure 10 also serves as a structural carrier for other separate and loose components as discussed herein. Lower half 18 and upper half 38 are injection molded as is known to one skilled in the art in a configuration to conform to standard intermodal container dimensions. It is contemplated that structure 10 may be formed as a single structure. Various components, as discussed herein, are implanted with lower half 18 and upper half 38 during formation of structure 10.

The lower and upper halves 18, 38 are injection molded utilizing a high, (for example, 3 to 6 pound per cubic foot) density foam plastic (for example, Styrofoam) material, which is injected and cured in the mould as is known to one skilled in the art. A wood matrix material and/or recycled waste material may also be used for fabrication of halves 18, 38. The molds may be made of steel or aluminum and configured to fabricate lower half 18 and upper half 38. This advantageous configuration allows the draft needed for releasing the halves 18, 38 from the moulds.

Figure 6:
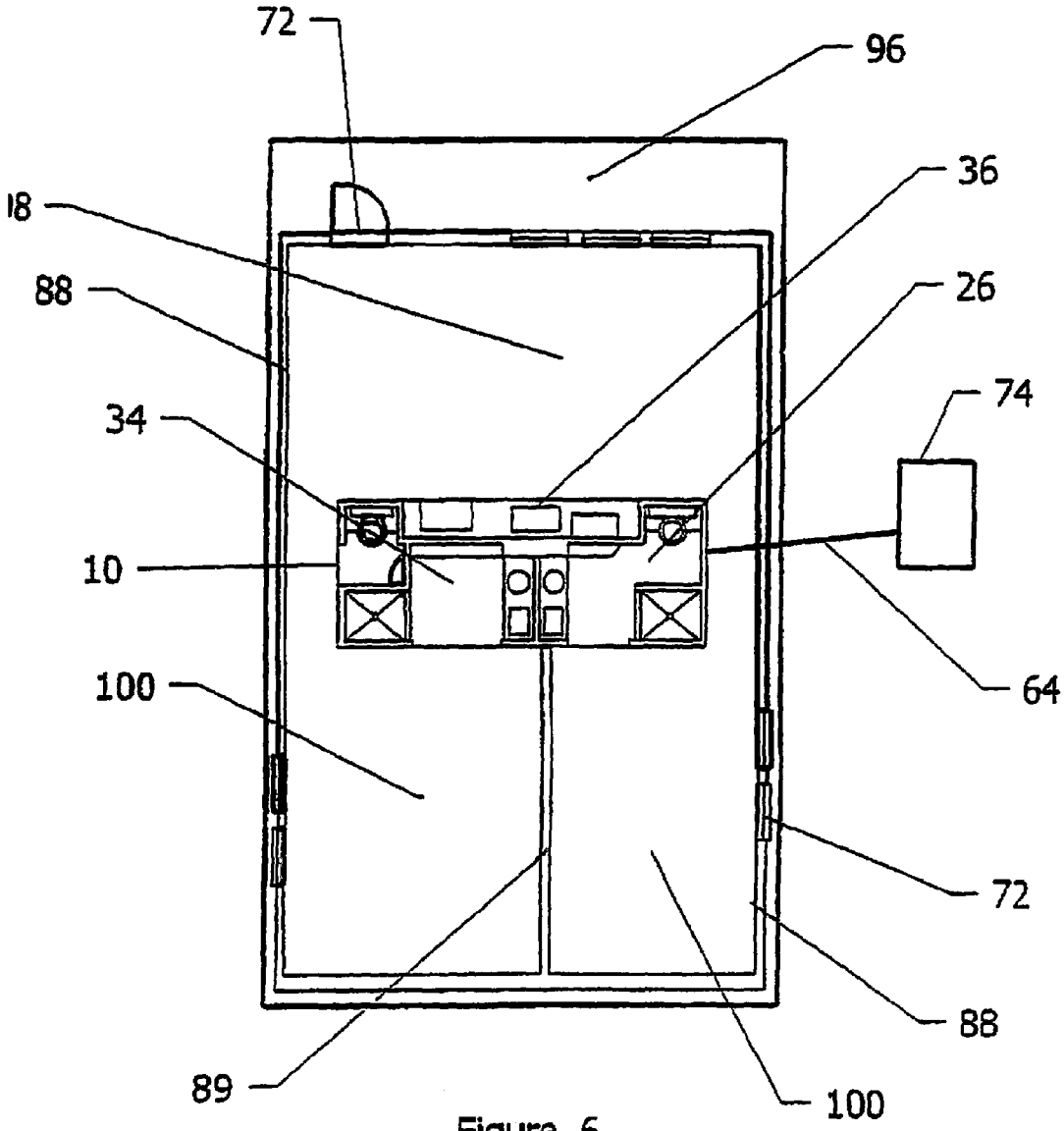
FIG. 6 is a top plan cutaway view of the self-contained structure configured as a dwelling.

Further, this process allows implants to be placed into the mould before injection of the plastic or other material. Such implants could be high pressure laminate floor surfaces, plumbing pipe trees and receiver fittings, electric chases or harnesses, reinforcing grounds or attachment points, shower pans 28, and universal intermodal corner fittings 50 and reinforced edges 51. Implants can include waste lines cast into mould of structure 10 and have a terminus at either end to be connected to the exterior installed septic tank 74, as shown in FIG. 6.

After each of first half 18 and second half 38 have been released from their respective moulds, a process to join the sections and finish the connections and surfaces is employed. It is envisioned that a coating may be applied to the various surfaces such as a hard finishing compound, etc. Structure 10 is joined with corner reinforcement 51 and other reinforcements, and conforms to international intermodal container standards. Lower half 18 and upper half 38 are joined, which creates a plurality of cavities 14 therebetween. Cavities 14 are disposed within structure 10 about the various structures of structure 10, such as bathrooms, walls, partitions, etc. Various components are installed with lower half 18 and upper half 38.

Installed components such as refrigeration 62, toilets 30, sinks 32, solar panels 90 and battery bank 52 are then added to structure 10. Installed components may be used with structure 10 to achieve the overall goals of enhanced energy efficiency and conservation, long term reliability and simplicity in use. Installed components are completely installed into structure 10 and connectable with core or local utilities. No additional or minimal work is required at the final building site for installed components. It is contemplated, however, that parts of systems may be added or created during factory molding of structure 10 such as shower pans 28, skylights 54, cabinets and countertops. Such additional systems may include water conserving techniques and recycling, and related equipment, including bathing, laundering and sanitary components. Purification systems may also be employed.

Structure 10 may also include a highly efficient photovoltaic system with battery storage and computer power management to include lighting, Internet and ventilation. These systems can be installed with ceiling 40 adjacent and under the rim of water tank 44. Batteries 52 are disposed below ceiling 40 in the central part of structure 10. Other placement configurations are also envisioned.

The systems of structure 10 may also include energy efficient food management equipment, and cooking and cleaning systems. These may include highly efficient refrigeration, which would warm water held in a separate pre-molded roof tank. Cooking equipment can be equipped with anti-bacterial devices such as ultraviolet light exposure devices.

Roofing membrane 46 is preinstalled or flashed into the inner wall of water tank 44 and easily deployed by rolling it out and unfolding it onto roof deck 86. It is contemplated that a roofing membrane is provided for each side of roof 86. It is further contemplated that tank 44 may be configured to collect and/or harvest natural elements, such as, for example, rain, water condensation, and may include solar collecting elements.

Deployment items or materials needed for the completion of the housing unit are disposed within the plurality of cavities 14. Deployment items include beams 78, or the structural components to span from the edge of the structure 10 at the final site to the locally built exterior walls 88. For example, beams 78 are fabricated from composite materials and sized to span the length of sleeping rooms 100 and common room 98, and are sloped to collect rainwater and drain into water reservoir 44. Beams 78 create roof 86. Panels 12 span roof 86 creating a solid deck surface onto which roofing membrane 46 is deployed. It is contemplated that panels 12 may be about 1 inch thick and 4' by 8' in size, and that a plurality of panels 12 may be used. Windows 72 and doors with screens are fabricated, for example, with PVC material and glass. Windows 72 and doors are installed into walls 88, which also can be constructed from local materials.

A sanitary system of structure 10 includes septic tank 74, which (for example, 800 gallons and/or 5' by 5' by 4' fabricated from polypropylene) is installed into the final site adjacent to the constructed dwelling (FIG. 6). Tank 74 is pre plumbed with a leaching field and attached to branch connections 64 of the waste line of structure 10. This sanitary system can include a combination of waterless composting and conventional septic as is known to one skilled in the art. It is envisioned that advanced concepts in sanitary design may be used which are designed to generate organic soil from human waste as is known to one skilled in the art. An additional water storage tank in the form of a flexible fabric tank can be disposed at the final site, above or below ground. The additional tank may hold an additional 1,000 gallons of water. Depending on the climate, one or several additional tanks can be employed to supplement the 1,000 gallon water tank 44 of structure 10.

When the moldings are completed and the installed components are tested (for example, by connection to utility systems and quality tests), the remaining cavities 14 within structure 10 is filled with deployment items such as beams 78, which slide in through openings 58 at each end of structure 10, and are placed under ceiling 40 running the full length of structure 10. Septic tank 74 is disposed in second bathroom 26. Doors and windows 72 are disposed on their edge on the floor in first bathroom 34. Secondary water tanks are folded and positioned above the toilets. Panels 12 sheath the entire structure 10, including four sides and roof 86. It is envisioned that panels 12 may be several layers deep with staggered joints, which may be screwed into structural implants as a final step to reinforce and protect the entire package of components of structure 10.

Deployment items are disposed within the plurality of cavities 14 of structure 10. It is envisioned that such various efficient building products may be utilized to construct the dwelling unit employing structure 10. It is contemplated that these items are partially installed into the core itself, such as roofing membrane, or are provided loose ready for installation at the final site.

Incidental or loose items can include cooking utensils, tools, Portland cement (for example, to stabilize compacted floor and foundation construction), polypropylene carpet, moderate heating system and Internet ready computers. Such incidental items may also include bicycles, clothing, temporary supply of food, bedding, books, school supplies, musical instruments, sporting goods, etc.

Incidental items can be placed in the remaining spaces, including the shower stalls, areas in and above the cabinets and counters, space in water tank 44 and below the solar panels. It is envisioned that these spaces are concealed and protected under panels 12 sheathing.

Figure 7:
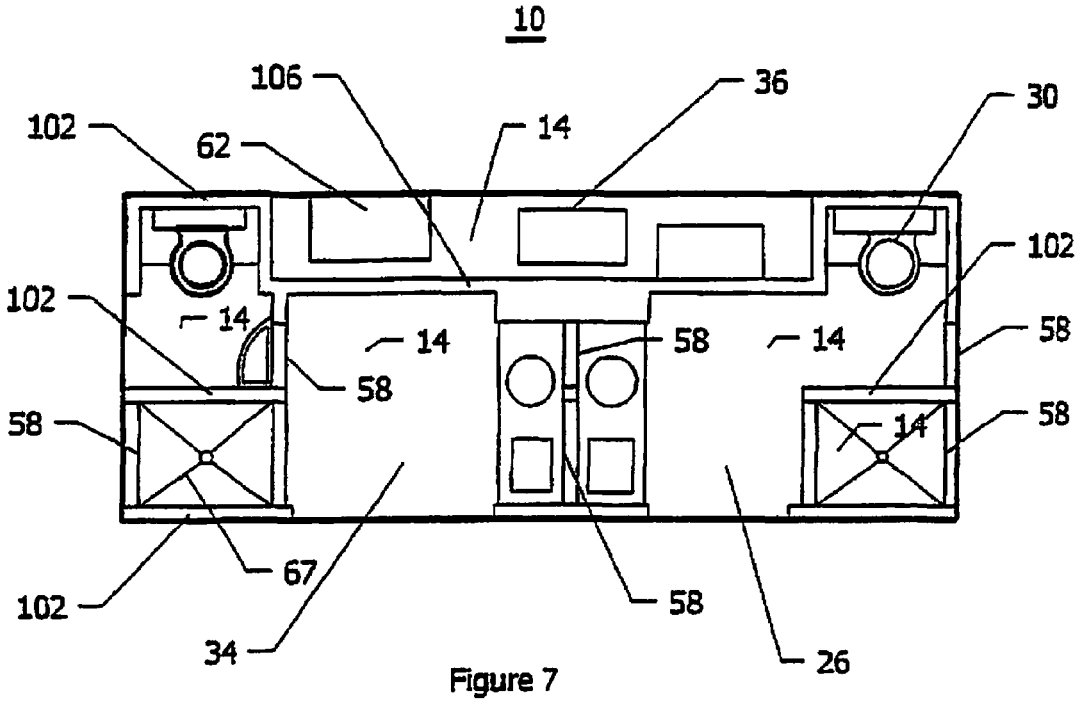
FIG. 7 is a top plan cutaway view of the housing core shown in FIG. 6.

Structure 10, in its shipping container configuration, is transported in containerized form via intermodal freight transport as is known to one skilled in the art. Referring to FIGS. 5-7, the containerized structure 10 is transported via intermodal transport to the final site or desired location for constructing the dwelling unit. Structure 10 is disposed for construction at the final site.

Deployment items and incidental items are removed from structure 10 for assembly and/or construction. Branches 64, which extend the electric and sanitary systems beyond the core as needed to construct the dwelling unit are assembled and connected as required. Roof 86 is constructed, as shown in FIG. 5, from beams 78 spanning between the upper edge of structure 10 and final site exterior extension walls 88. Interior portion wall 89 could be built in various configurations, in accordance with the principles of the present disclosure. Photovoltaic cells 90 are fixed and flank each side of light/vent shaftway 54. Beams 78 and panels 12 are configured to form a rainwater collection surface 92. An interface 94 defines a conduit between collection surface 92 and water tank 44. Membrane 46 is rolled out to cover the roof deck created by panels 12. It is contemplated that membrane 46 may cover all or only a portion of the roof deck.

Extension walls 88 are constructed with structure 10 to form an adequate size dwelling. Other sized dwelling space is also contemplated. The dwelling space may be variously configured to meet the requirements of a particular building site and/or preferences of a user. As shown in FIG. 6, the dwelling unit includes a porch 96. Porch 96 may be variously configured and dimensioned, or may not be included. The remaining portion of structure 10 is centrally disposed within the dwelling unit adjacent to living area 98 and sleeping areas 100. The toilets are connected for communication with septic tank 74, which is buried exterior and adjacent to the dwelling unit. First bathroom 26 and second bathroom 34 are desirably located, as well as food preparation area 36. Windows 72 and doors are mounted and positioned with extension walls 88 as desired.

Figure 8:
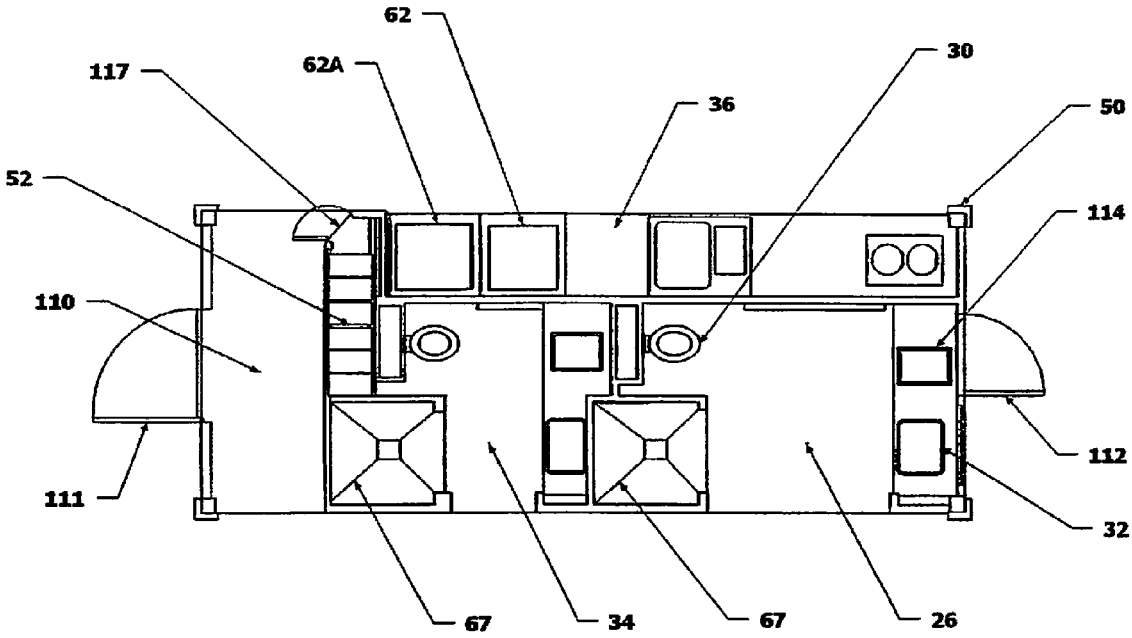
FIG. 8 is a plan view of an alternate embodiment of the housing core below the ceiling of the structure.
Figure 8A:
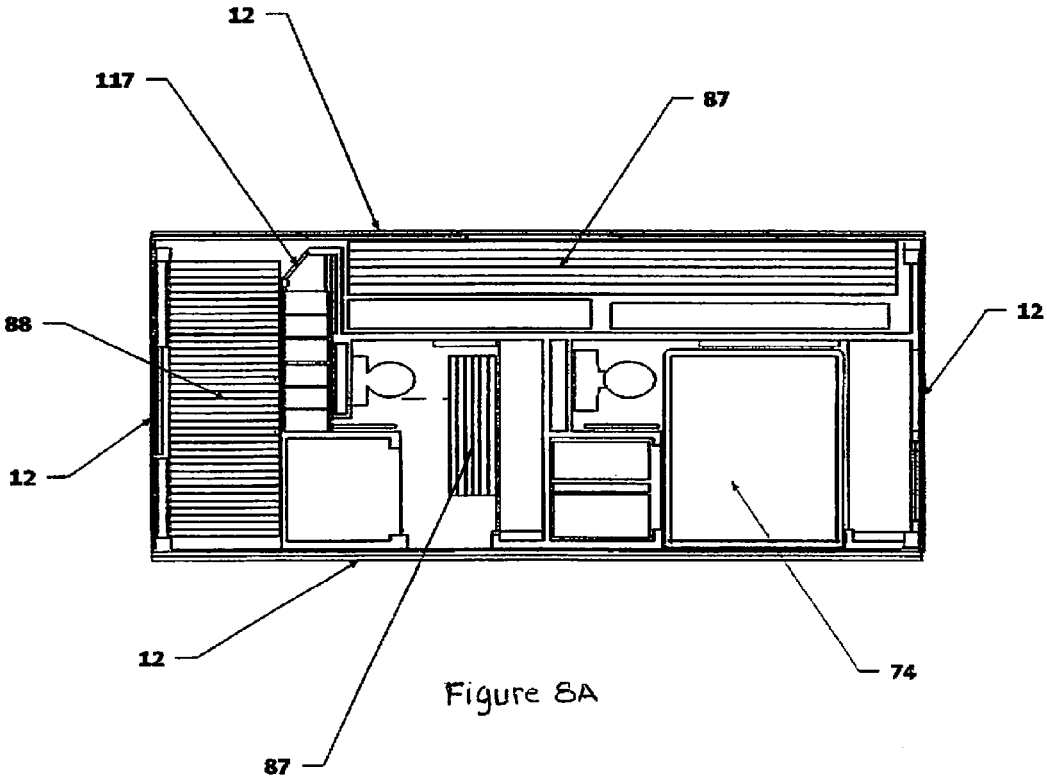
FIG. 8A is a plan view of the alternate embodiment of the housing core shown in FIG. 8 with wall panels and other materials in shipping position.

In an alternate embodiment, FIG. 8 shows the core in plan view below the ceiling. This plan shows an entrance vestibule and corridor 110 which advantageously allows circulation between the food preparation side of the house and the sleeping side through the core and also from the main entrance door 111 into the dwelling. Rear emergency exit door 112 is located for exiting over the laundry sink 114. Note the plurality of dual purpose cavities created 110, 34, 26, 36, and 67 which will also be used to transport required materials for the construction of the dwelling on the final site as shown in FIG. 8A, most notable being the exterior wall panels 88, and the septic tank 74. Also note the dual use protective panels/roof deck 12.

Figure 8B:
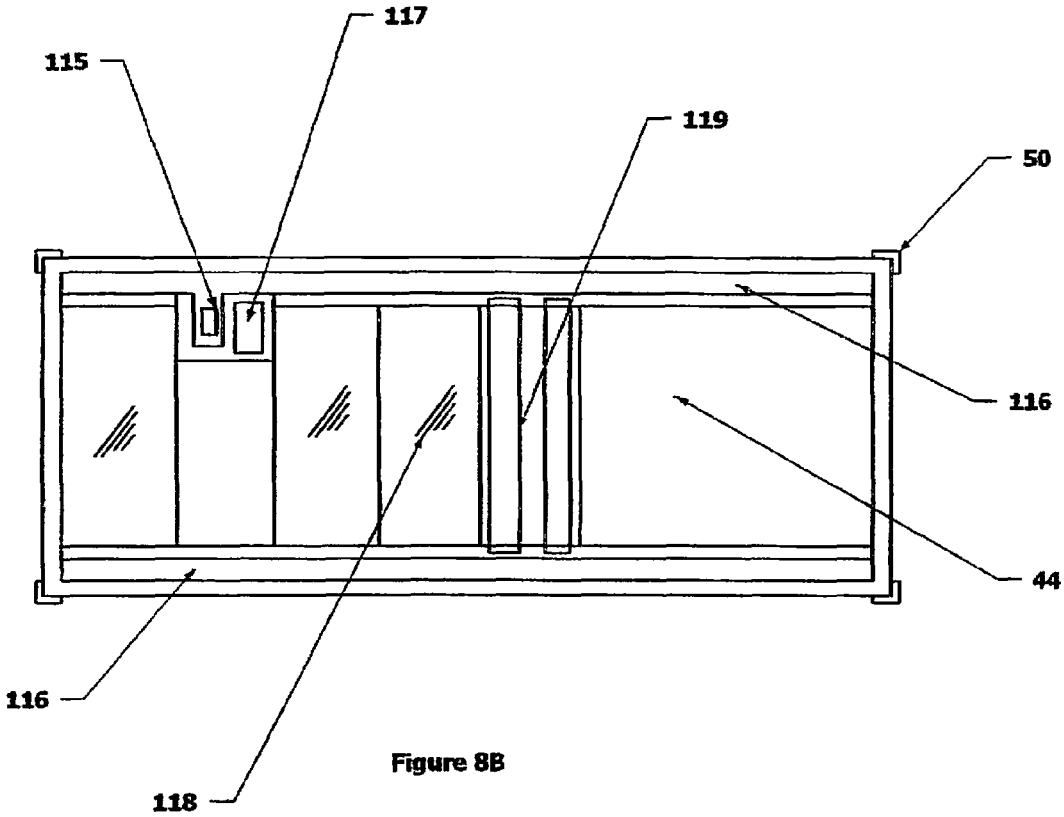
FIG. 8B is a plan view of the alternate embodiment of the housing core above the ceiling shown in FIG. 8.
Figure 8C:
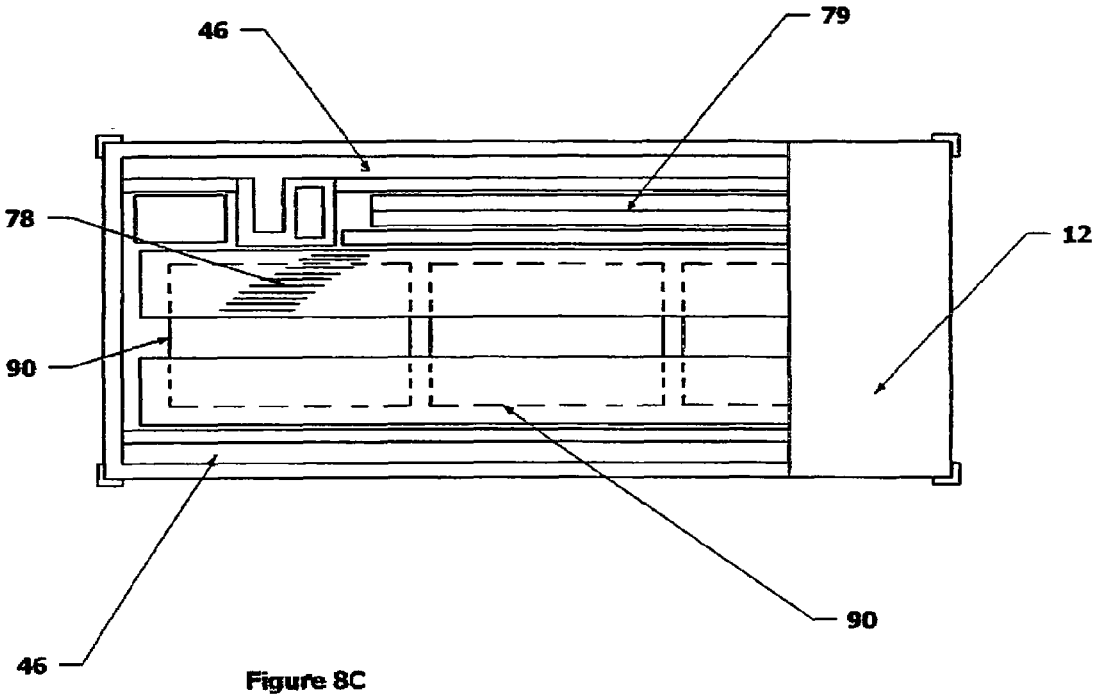
FIG. 8C is a plan view of the alternate embodiment of the housing core above the ceiling shown in FIG. 8 with roof beams and other materials in shipping position.

FIG. 8B shows the core in plan view above the ceiling, and FIG. 8C shows the 'transport use' of the cavities above the ceiling. The interface and connection between the electrical and mechanical elements below the roof and above the roof occurs thru the manifold 117 which is the exterior manifestation of the "core within the core". In FIG. 8C note the shipping position of the long beams 78, columns 79 and protection/roof deck panels 12 all of which will be used to create the roof which flanks both long sides of the core. Note that the roof membrane 46 is appropriately attached and transported in the trough 116 ready to be stretched over the roof deck.

In another embodiment FIG. 8B shows in plan the water collection trough 116 which is the first stop in collection of rainwater (allowing any carried along sediment to first settle out), which then overflows into the reservoir 44, which has glass or other covers 118 and reflective adjustable louvers 119. These elements are also shown in section in FIG. 11B which also shows the transition of the membrane 46, which is supported by the protective panels 12 and the beams 78, positioned to convey collected rain water into the collection trough 116 which then fills the reservoir 44. The reservoir cover 118 will allow solar radiation to enter the reservoir trapping heat and warming the water for use in washing and showering and heating, while its temperature can be controlled by the manipulation of the reflective, insulated louvers 119, from the closed position (for cool nights) to degrees of reflection away (so as not to overheat on hot sunny days), to reflection into the reservoir, which may be colored dark to absorb radiant energy (for cool sunny days). Such manipulation of louvers will allow efficient production of warmed water.

Water collected in the troughs 116 which does not enter the reservoir will be utilized, when needed, to cool down solar panels, which increases their efficiency. In addition the deployment of such water will cool down the roof, to help control solar heat penetration into the house on hot sunny days, and wash down the roof, even on non rainy days, facilitating the harvesting of rain water. Pump 115 shown in FIG. 8B will pressurize a washdown system comprising of hoses and or pipes on the roof.

Figure 9:
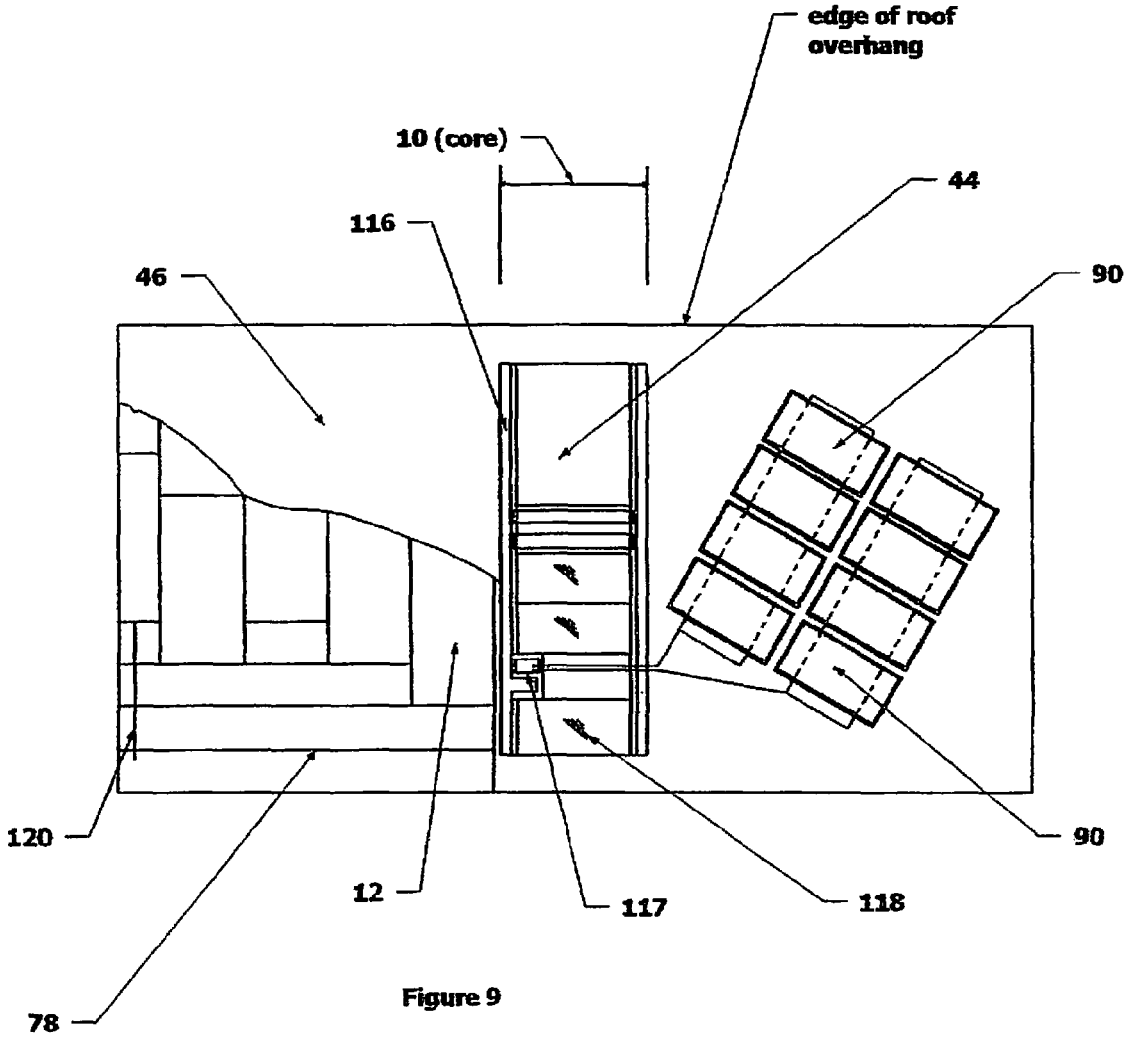
FIG. 9 is a roof plan partial cutaway view of the self-contained structure configured as a dwelling.
Figure 10:
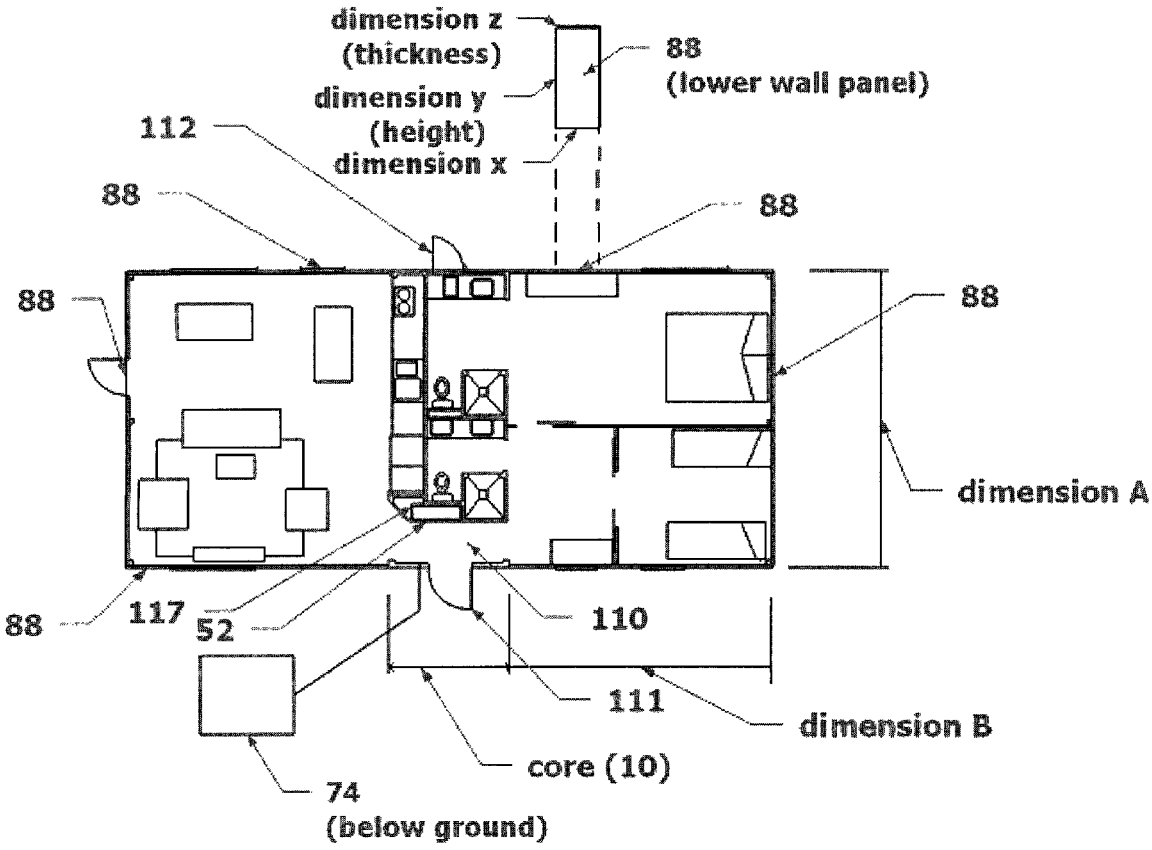
FIG. 10 is a top plan cutaway view of the self-contained structure configured as a dwelling.

In another alternate embodiment, FIG. 9 shows a solar panel arrangement on one side of the roof of the dwelling. Of course additional solar panels can be placed on the other side and the generally symmetrical design should be noted and in particular the central location of the external manifold 117. This is the exterior connection of the "core within the core" also extending and located below the ceiling (e.g. 117 in FIG. 10), which contains the main electric elements including distribution panels, battery chargers to store electric power from the PV solar panels and inverters; it may also house the primary water purification equipment. The location of this "core within the core" is central to both the power generators (PV solar panels), as well as the main power loads. It is estimated that this central design and consolidation will use one fourth to one tenth of the pipe and wire used in conventionally built homes. All elements shown in FIG. 9 are shipped with the container, notably the roof beams 78 and girder 120, roof deck 12, roof membrane 46, solar panels 90 and bracket supports and the reservoir cover 118.

Although the design consolidates four spaces of a home, entry foyer and corridor 110, two baths 26 and 38 and the food preparation area 36 access and circulation between spaces works well. Bathrooms are adjacent to sleeping rooms and the food preparation space is on the opposite side of the core, separated by the entry foyer and corridor, creating privacy. Architecturally the floor plan provides adequate distance between the functions, yet does not waste space. The spaces have good flow and relationship, and are adequate in size.

Many other plans are possible some with 3 or 4 sleeping rooms, or with study rooms. The house can be oriented to the street showing the short side or from the longer side.

In an alternate embodiment, structure 10 includes the materials for extension walls, similar to extension walls 88, which are assembled with structure 10, via disposal with cavities 14, prior to transport at a manufacturing facility or the like. Structure 10 includes the materials of the extension walls to form a complete dwelling or housing unit for inter modal freight transport and construction at a final building site, similar to that described herein, to provide a home in various geographies. Structure 10 has the materials to create an exterior wall system including the extension walls to complete the dwelling unit including structure 10. Other materials and quantities are also contemplated.

In order to supply panels to enclose the interior space of the dwelling, to maximize the manufacturing efficiency of such panels and to allow on-site flexibility in the floor plan arrangement of the dwelling, it is necessary to maintain the same dimensions (width x, height y and thickness z) in all exterior wall panels 88 which may contain exterior windows and doors (indicated as lower exterior wall panels), so that their installed locations are interchangeable, There is a unique mathematical result for the width (FIG. 10 dimension "x") of such lower exterior wall panels 88 as they will be used in conjunction with a configuration of a 20 foot size container. The container dimension has limitations which effect such wall panels required to complete the dwelling, as follow: (1) dimension A (the length of the longer exterior wall made up of such panels) is fixed to the length of the container less the offset for the protective panels 12 and the thickness of 2 panels or 19'-10½" minus 2×1½" minus 2×2¼"=19'-3" or 231 inches; (2) dimension B (the length of the other, shorter, exterior wall to be made of the same such panels) can be as great as possible, but the beams 78 which control this dimension must fit into the longest available dimension of the container, and must accommodate the end bearing of 3½", slope offset of ¼", two wall thickness of 2¼" and an overhang of 12" which is equal to the overhang along Dimension A; and, (3) mathematical calculations reveal one appropriate multiple of panels with dimensions x and z (i.e. width and thickness) which is: a panel of 33 inches wide and 2¼" thick of which there are 7 panels making up the longer wall and 6 panels making up the shorter wall. This advantageous arrangement will allow interchangeability of all lower panels, including solid panels, those containing windows and those containing exterior doors.

Figure 11B:
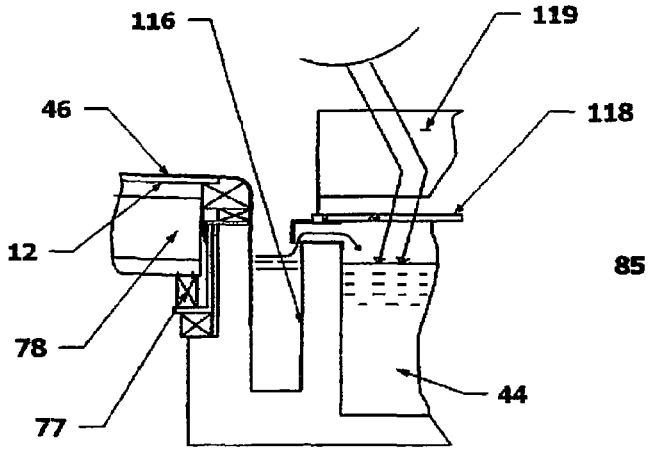
FIG. 11B is a detail sectional cutaway view of a water collection system of the self-contained structure configured as a dwelling.
Figure 11C:
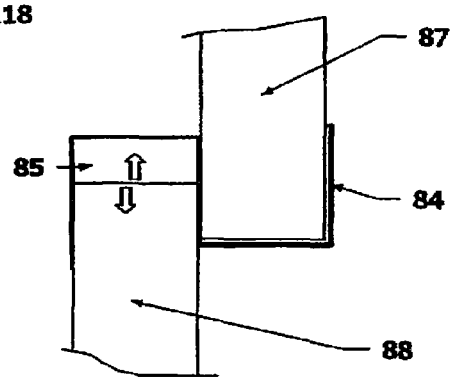
FIG. 11C is a detail sectional cutaway view of a panel connection system of the self-contained structure configured as a dwelling.
Figure 11A:
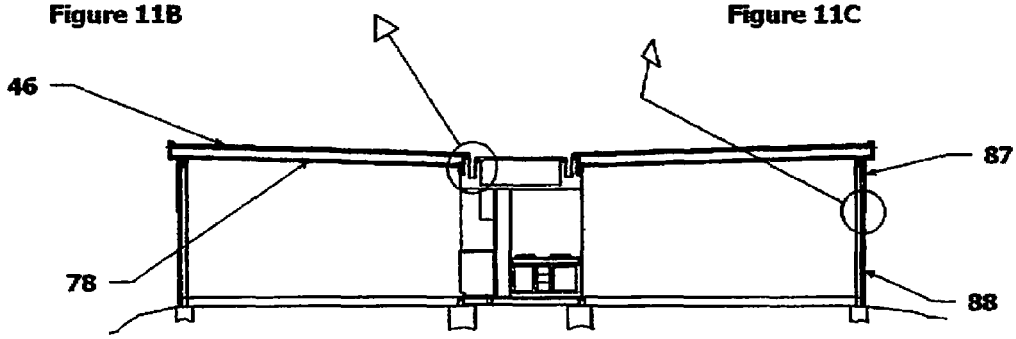
FIG. 11A is a front sectional view of the self-contained structure of FIG. 11.
Figure 11:
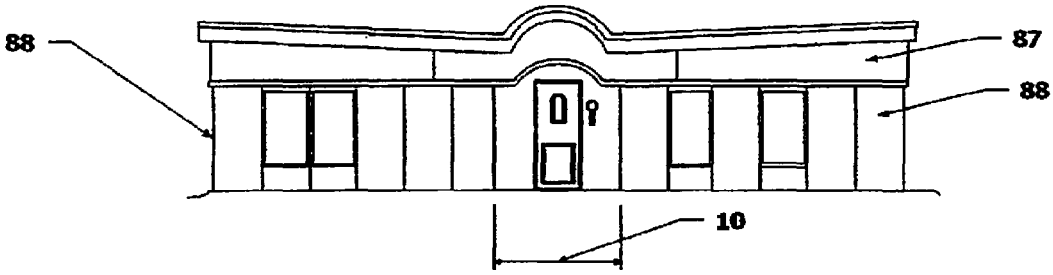
FIG. 11 is a front elevation view of the self-contained structure configured as a dwelling.

The exterior wall enclosure is made up of two types of panels as shown in FIGS. 11, 11A and 11C. The lower wall panels 88, which are all the same size width and thickness as above, are overlapped by the upper wall panels 87 and both are captured in the horizontal Zee member 84. The lower panel is inserted halfway into its assigned zee cavity and sealed in place with a flexible adhesive/sealant. Since the wall panels are rigid, the lower wall panels containing windows and doors, vertical forces (as may be encountered in ground tremors and earthquakes) which cause displacement of the panels would normally have no place to go, and would lead to buckling of the panels. The overlapped panels with the inclusion of expansion space 85 would allow the rigid panels to move without damage under such forces, making them resistant to earthquake type forces and other vertical displacements.

Three planes including the roof and two short ends of the core, when deployed in the dwelling, are exposed to the exterior elements which enables the core to perform many functions namely: store and purify water from its rain harvesting roof, have easy rooftop connectivity for solar panels thru the provided manifold 117, harvest natural daylight from the ends into the foyer and main bath, and have factory built in ingress and egress thru two doors, one being an emergency exit. Also air vents, and ventilation can communicate thru these exposed exterior surfaces accommodating the electric equipment, battery storage area, cooking area, plumbing vents and air conditioning, as well as antenna and/or sensors to monitor the weather and help manage the resources: water, solar power, wind, heat etc., all preinstalled in the factory prior to shipping. These functions would not be possible if some planes of the core were not exposed to the exterior elements.

The wide opening to the bathroom 26 allows the placement and removal of the septic tank. On the food preparation side of the core all the appliances for a kitchen are installed including the counter and wall cabinets. The refrigerator 67 and 67A can be a special design top loading unit to conserve energy and to allow the space above to be clear with no vertical element to enable transport of the upper exterior wall panels 87; it also creates a more spacious appearance for the kitchen.

The alternate method of the core's construction is built in the factory, with the structural frame of steel or other appropriate materials as it will need to withstand all loading including, transport loads, wind loads, seismic loads, live and dead loads from gravity, the environment and the water storage reservoir. Accommodating all the above will firstly be the chassis or platform upon which the core is built. It is contemplated that the chassis is to be built of a metal framework incorporating and satisfying all the requirements. At an appropriate time, added to this structural platform will be the main waste drain and any other utility accommodations as well as floor surfaces. FIG. 12 is a sketch of an alternative platform or chassis.

The core's overall exterior dimensions are specified by ISO standards to be 19'-10½ long by 8'-0" wide by 9'-6" high (high cube container). The container has to fit amongst other containers so that it cannot be larger. In addition ISO specifies precisely the position of the corner fittings 50 so that it can be lifted and handled by standardized equipment, again the position of the corners cannot be larger or smaller. The roof decking for the house will be used to clad and protect the core and this will be 2 layers thick netting out to about 1½"" of thickness. To do this, construction 121 of the core will be shrunk back (shown as 122) from the overall exterior dimensions by about 2" from each side and roof. The corner fittings 50, however, will remain in their specified position. The strength and lifting loads of the container are also specified by the ISO standards and must be transmitted from the corner fittings to the structure of the container. The shrinking back of only the main structural elements, not the corner fittings, of the core enable it to be protected with reusable material and still conform to shipping standards.

Figure 12A:
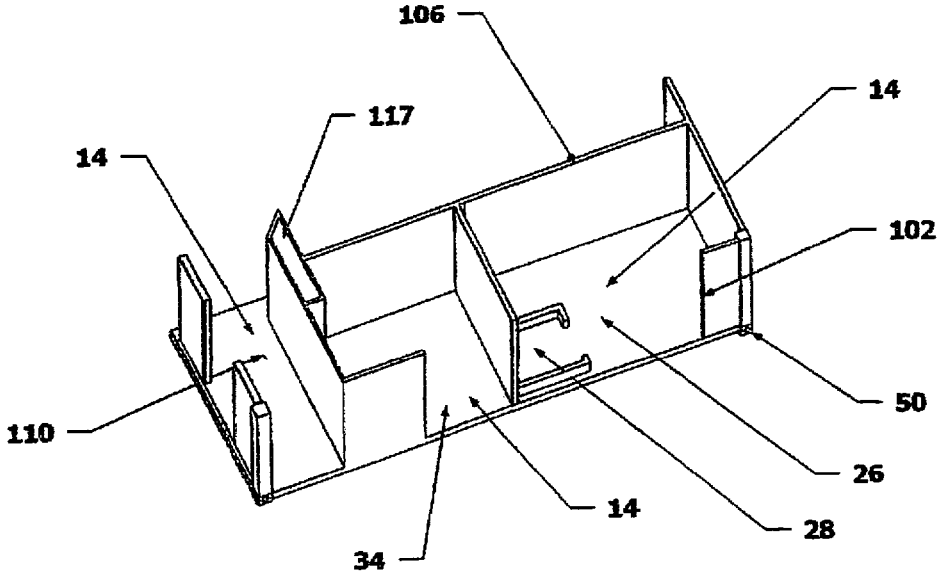
FIG. 12A is a perspective cutaway view of wall panels installed on the platform of FIG. 12.
Figure 12:
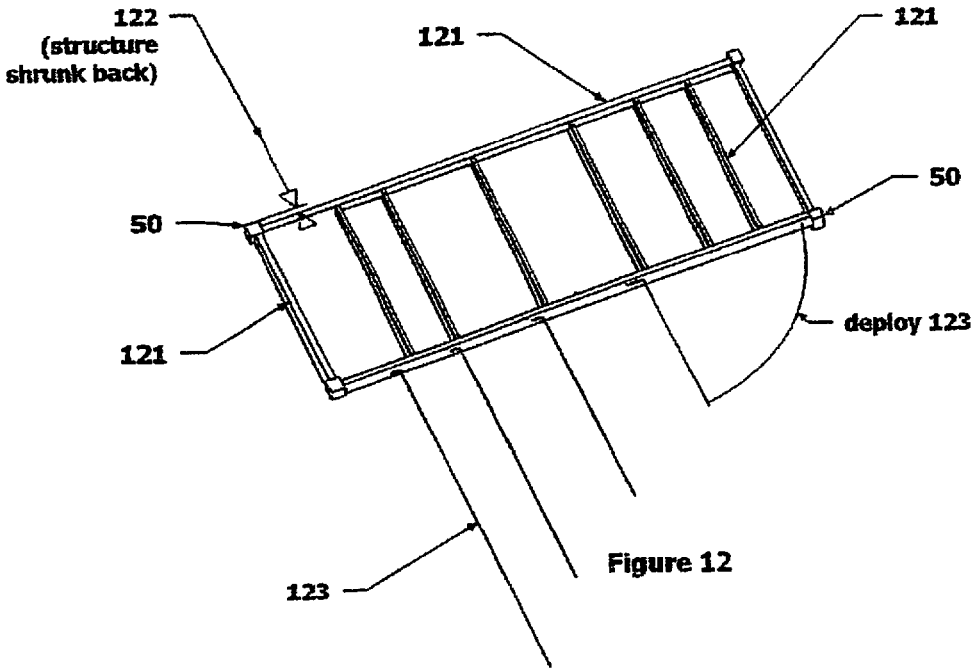
FIG. 12 is a perspective view of a platform of the self-contained structure.

The vertical wall panels FIG. 12A (102 and 106) are next installed to the platform. These could be made several different ways or by a combination of methods. They can be built offline in varying degrees of completion, have utilities incorporated, and be added to the platform. These could be simple flat panels, L-shaped, or more complex. They could be made into one subassembly or as many. Generally they will create the alternate configuration shown in FIG. 12A. They will be able to accommodate full standing room or about 6'-10" tall. They will create the plurality of cavities 14 and or human spaces such as the baths 34 and 26 and showers 28. Construction methods include but are not limited to: steel structural members, skin panels, molded material and extruded material, and can have edge details to facilitate overall assembly and incorporate features as part of the manufacturing process such as: soap holders in shower walls, pockets for lighting fixtures, pumps and sensors, and brackets and reinforcements. FIG. 12A is a sketch of these wall panels installed to the platform.

The ceiling and roof portion of the core which is exposed to the exterior and the elements could be built offline and be installed onto the platform with walls in place. This subassembly could be a singular entity having dimensions of approximately 19'-6" long by 7'-8" wide by 2'-0" high, and would embody the ceiling of the cavities of the core created by the vertical walls. From the top it would be the water reservoir which collects and holds the rain water. It can also include the exterior manifold 117 which would communicate with the mechanical "core within the core" 117 below the ceiling.

Figure 13:
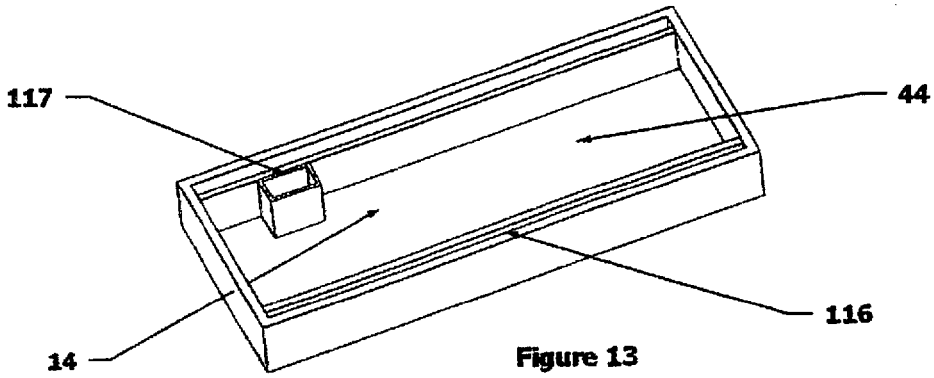
FIG. 13 is a perspective view of a subassembly of the self-contained structure.

This upper assembly could be built many ways some of which may be: built on its own platform, with short "stub" wall panels attached; molded, or injection molded mostly complete, but also in parts; extruded with secondary end caps; vacuum formed, whole or in parts; air bag formed against a mold, or laid-up like a boat hull. It could be built onto the chassis (FIG. 12) with steel structural members and combined with all such structural members so that the entire structural frame can act as a unitized structural element. FIG. 13 is a sketch of the upper section as may be built with this alternative method of assembly. By combining the lower chassis and its significant structural strength with the upper assembly and its structural strength with the vertical wall (106) which runs more than half of the length of the core, an I-beam configuration is achieved bringing greater strength to the assembled structure.

Once the core takes its full shape it would continue to be finished to the level of its final completed form. All utility service pipe and wire would be completed. Then, depending on materials and methods used additional operations would be preformed in the factory with varying levels of automation. Surfaces such as spray on coatings, ceramic tile or natural stone could be used. Appliances, fixtures, set ups for PV solar panels, storage batteries, membrane roofing would be installed with varying levels of automation. Quality would be assured at every operation and the repeatability of operations would improve the efficiency of the manufacturing process.

From the start the core was designed to be an integral component of the dwelling, but its ability to transport other materials such as exterior wall panels which enclose space outside of the core is an important innovation. Incredibly efficient because of volume procurement, direct from manufacturer to end users, with "free" transportation is part of the cost effectiveness. Also since these components could be precut, with all the preparation done in the factory, the construction of the balance of the house is a lifting and putting in place operation. Any able bodied person could build a house for himself, as there would be no need to fabricate, measure or cut components on site. And with no central infrastructure needed, approvals, red tape, and other forms of frustration can be eliminated, depending, of course, on the local government. This "sweat equity" aspect not only lowers the cost of the home, it potentially creates local jobs for those with little to no training or experience-a difficult thing to do in the modern construction world.

The method disclosed also relates to delivery. Once all the fixed and installed items are tested and approved, the core then becomes a vehicle for the containment and delivery of all the necessary loose items to complete the dwelling. Such items will be loaded into the plurality of cavities available and purposely designed for the dual use of transporting materials and then becoming space for people to use and or their water to occupy and to capture natural resources. The final step in the factory would be the installation of the reusable protective panels 12 as the exterior skin of the container, adding corners or flexible materials to assure a compliant, weather tight container (FIG. 1) and affixing the required ISO designations.

The cost of a home is beyond the financial reach of a great portion of the world's population. Any method to reduce the costs in constructing a home would make the cost of a home more affordable to a new and larger market or population. In addition to materials, the cost of building a house is increased by the amount of time and labor, as well as the skill level of the workers, needed to complete the many tasks that go into the construction, particularly on site where weather can impact production. The costs include: ordering, receiving, checking, correcting mistakes and protecting materials; conforming material into the design, which includes unpacking and positioning materials, understanding construction drawings, and the well known "measure twice cut once" operation; resolving unanticipated or unspecified conditions or details; lifting, placing and securing; disposing of garbage and cleaning up; and, coordinating the specialized and skilled labor (electricians, carpenters, plumbers, roofers etc.). One aspect of the present is to eliminate much of this cost.

In addition to the efficient use of materials, special attention to the efficient use or need for labor at the site is incorporated into the invention, further reducing the cost. No skilled tradesmen (electricians, plumbers, carpenters etc) are required to configure the structure from the shipping container to the dwelling. All materials except those that form the compacted stone foundation and compacted earth floor, which are inorganic material naturally available at the final site, or local concrete are delivered with the container. These materials range from wood I-beams, posts and beams, plywood decking, soffits and metal fascia to rubber membrane, mounting brackets, wire and solar panels for the roof to wall panels with windows and doors, flashing and trim, with insulation and ceiling panels. All are prefabricated in controlled, automated conditions in the factory, then carefully inspected, counted and placed in the designated position in the structure configured as the shipping container, utilizing appropriate sized cavities and requiring minimal to no disposable packing material. When appropriate, some materials first used for packing will be used in the construction upon its unpacking. The tolerances which can be achieved in the factory with a standardized design will lead to enormous cost savings. Any able-bodied person will be able to perform all the functions to complete the house. In fact no "measuring and cutting" of any materials is required. All parts are designed to be simply lifted into place and secured, if needed, with simple power tools, deriving their energy from the battery bank. FIG. 11B also shows how the roof beams 78, decking 12 and membrane 46 will be structurally attached to the upper structure of the core 77. Special jigs created to locate the post footings, consisting of pre-measured cables which can be deployed in a diagonal configuration, may be included and attached onto the structural frame of the structure assuring the accurate installation of these post foundations relative to the core without the need to measure. Assembly of the prefabricated posts 79 and girder 120 that support the far end of the roof beams 78 along with the lateral stability of the core will make framing the roof a simple task. Additional reinforcement, or "rebar" (e.g. 123 in FIG. 12), normally used to reinforce the structural floor (slab) adjacent to the long sides of the core, can be installed to the lower structural platform of the core, transported by the core and easily deployed into the floor as the structure is transformed into the dwelling. Similar to the membrane and roof construction this will bind the core to the extended portion of the dwelling at the floor level.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A self-contained structure configurable as a shipping container and as a dwelling, said structure comprising:

a lower section including a platform and a floor, said lower section forming a first portion of a foundation of said dwelling;

an upper section including a ceiling and connected to the lower section to define a cavity, said upper section forming a first portion of a roof of said dwelling;

a plurality of wall components attached to said lower section and said upper section within said cavity to form subcavities within said cavity;

a plurality of panels attachable to said lower section and said upper section to enclose said cavity when the structure is configured as the shipping container and attachable to said upper section to form a second portion of said roof of said dwelling extending from said first portion of said roof to define an approximate area of said dwelling when the structure is configured as the dwelling;

a plurality of extension walls storable within said subcavities when the structure is configured as the shipping container and configurable to enclose said approximate area of said dwelling when the structure is configured as the dwelling; and a system to harvest rainwater for use secondarily in the dwelling unit, said system comprising:

a reservoir cavity having a receiver trough and located above the ceiling of the dwelling;

a receiver trough located adjacent to the reservoir cavity;

a roof deck collection surface on the roof of the dwelling;

a water proof membrane attached to the receiver trough, and stored in the receiver trough when the structure is configured as the shipping container, to be deployed out of and onto the roof deck when the structure is configured as the dwelling, creating the rainwater collection surface, wherein the receiver trough receives rainwater runoff from the roof deck membrane, settles out suspended sediment before, and directs the rainwater to enter the reservoir cavity.

2. The self-contained structure of claim 1, wherein at least one of the plurality of wall components spans at least on-half the length of the lower section forming an I-beam structure with the lower section and the upper section and is structural in nature to support loads when the structure is configured as the shipping container and to support the roof when the structure is configured as the dwelling.

3. The self-contained structure of claim 2, further comprising corner fittings connected between the lower section and the upper section at the corners thereof and structural in nature to support loads when the structure is configured as the shipping container and to support the roof when the structure is configured as the dwelling.

4. The self-contained structure of claim 1, further comprising loose items being disposed in the subcavities and reservoir cavity when the structure is configured as the shipping container, said loose items being used to configure the structure as the dwelling.

5. The self-contained structure of claim 4, wherein the loose items including at least one of roof beams, fascia, soffits and a septic tank.

6. The self-contained structure of claim 4, wherein said subcavities comprise living space upon the removal of the loose items.

7. The self-contained structure of claim 1, further comprising appliances and other fixtures installed within said cavity.

8. The self-contained structure of claim 1, wherein when the structure is configured as the dwelling the subcavities are configured as at least one of a bathroom, a kitchen, an entry vestibule and a corridor.

9. The self-contained structure of claim 1, further comprising at least one renewable power supply for providing power for said dwelling when the structure is configured as the dwelling.

10. The self-contained structure of claim 9, wherein the at least one renewable power supply includes at least one of a solar power system and a wind power system.

11. The self-contained structure of claim 1, wherein the system to harvest water further comprises:

a cover for covering the reservoir cavity and exposable to sunlight to heat the water in the reservoir cavity; and an adjustable, insulated panel having a reflecting surface located over the cover and configurable to regulate the amount of sunlight to which the cover is exposed.

12. The self-contained structure of claim 1, further comprising:

a solar power electricity system having photo-voltaic panels for supplying power to the dwelling when the structure is configured as the dwelling; and a water distribution system for pumping water collected and stored in the receiver trough of the reservoir cavity onto said photovoltaic panels to reduce the temperature of the photovoltaic panels, wherein said water pumped onto said photovoltaic panels is recollected into the trough of the reservoir cavity.

13. The self-contained structure of claim 1, further comprising fixed items contained in said subcavities and including at least one of a refrigerator, a freezer, a microwave over, an induction cooking range, a sink, a toilet, a bathtub, a shower, cabinets, countertops, finished floors, finished walls, ceilings, an entry door, a vestibule, a corridor, an emergency exit, a laundry sink, a drip drying trough, a battery back-up power supply, a battery charger, an electric inverter, electric panels, water pumps, waste and water supply lines, light fixtures, wiring, a wire chase, a fan, a window, air ducts, a heat pump, refrigeration lines, and exit manifold to the roof, a smoke detector, and warning alarms.

14. The self-contained structure of claim 1, wherein said extension walls are prefinished panels.

15. The self-contained structure of claim 1, wherein at least one of said extension walls includes at least one of a window and a door.

16. The self-contained structure of claim 1, wherein said extension walls comprise:

a lower panel having an upper end;

an upper panel having a lower end; and a horizontal member having a lower facing channel for accepting said upper end of said lower panel and an upper facing channel for accepting said lower end of said upper panel, wherein when accepted in said horizontal member said upper panel overlaps and is more exterior to said lower panel.

17. The self-contained structure of claim 16, wherein said lower panels of extension walls are interchangeable when configuring the structure as a dwelling.

18. The self-contained structure of claim 16, wherein said horizontal member provides flexibility in the extension walls.

* * * * *